US006144268A

United States Patent [19]

Matsui et al.

[11] Patent Number: 6,144,268

[45] Date of Patent: Nov. 7, 2000

[54] HIGH-FREQUENCY TRANSMISSION LINE, DIELECTRIC RESONATOR, FILTER, DUPLEXER, AND COMMUNICATION DEVICE, WITH AN ELECTRODE HAVING GAPS IN AN EDGE PORTION

[75] Inventors: Norifumi Matsui, Kyoto; Seiji Hidaka, Nagaokakyo; Yohei Ishikawa, Kyoto, all of Japan

[73] Assignee: Murata Manufacturing Co., Ltd., Japan

[21] Appl. No.: 09/169,613

[22] Filed: Oct. 9, 1998

[30] Foreign Application Priority Data

Oct. 9, 1997 [JP] Japan ..... 9-276813
Sep. 10, 1998 [JP] Japan ..... 10-256580

[51] Int. Cl.[7] ..... H01P 1/203; H01P 1/212; H01P 3/08; H01P 7/08; H01P 7/10

[52] U.S. Cl. ..... 333/134; 333/204; 333/219; 333/219.1; 333/238; 333/246; 333/995

[58] Field of Search ..... 333/204, 219, 333/238, 246, 219.1, 134, 995

[56] References Cited

U.S. PATENT DOCUMENTS 4,583,064 4/1986 Makimoto et al. ..... 333/219
5,311,159 5/1994 Miura et al. ..... 333/204
5,770,988 6/1998 Goto et al. ..... 333/219 X
5,920,243 7/1999 Ishikawa et al. ..... 333/204
5,920,244 7/1999 Kobayashi et al. ..... 333/219
5,922,650 7/1999 Ye ..... 333/204 X

FOREIGN PATENT DOCUMENTS 0 741 432 3/1998 European Pat. Off. .
7-94914 4/1995 Japan .
8-321706 12/1996 Japan .

*Primary Examiner*—Robert Pascal
*Assistant Examiner*—Barbara Summons
*Attorney, Agent, or Firm*—Ostrolenk, Faber, Gerb & Soffen, LLP

[57] ABSTRACT

The invention provides a high-frequency transmission line and a dielectric resonator having a small size and having an effectively reduced loss. When a transmission line is produced, an electrode is formed on a dielectric plate in such a manner that one or more gaps are formed in an edge portion of the electrode along an edge of the electrode thereby forming thin line-shaped electrodes whereby a current which would otherwise be concentrated to a great extent in the edge portion of the electrode is divided into a plurality of portions.

12 Claims, 33 Drawing Sheets

CONDUCTOR WIDTH = 1μm
SPACING BETWEEN CONDUCTORS = 1μm

α = 2.92

α = 3.59

α = 2.87

α = 3.15

α = 2.98

CONDUCTOR WIDTH = 1.5μm
SPACING BETWEEN CONDUCTORS = 0.4μm
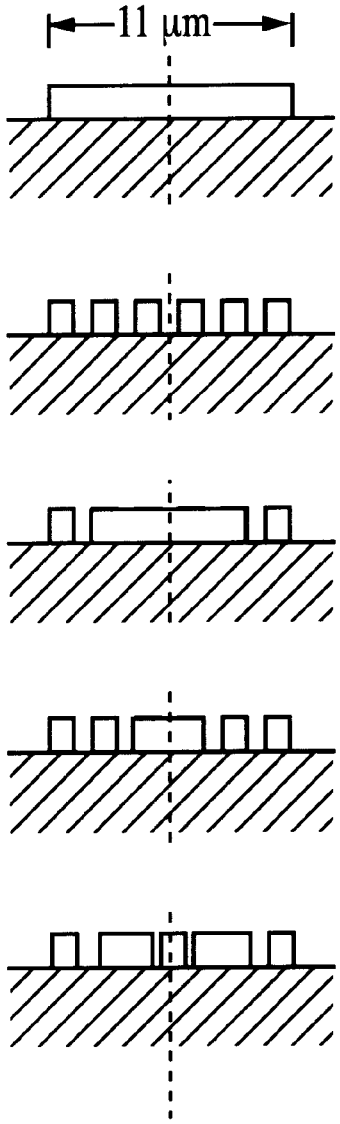
FIG. 32A α = 2.92
FIG. 32B α = 2.88
FIG. 32C α = 2.82
FIG. 32D α = 2.83
FIG. 32E α = 2.83

HIGH-FREQUENCY TRANSMISSION LINE, DIELECTRIC RESONATOR, FILTER, DUPLEXER, AND COMMUNICATION DEVICE, WITH AN ELECTRODE HAVING GAPS IN AN EDGE PORTION

BACKGROUND OF THE INVENTION

1. Field of the Invention

The present invention relates to a high-frequency transmission line and a dielectric resonator suitable particularly for use in a microwave or millimeter-wave band.

2. Description of the Related Art

Microstrip lines are widely used as transmission lines in high-frequency circuits because of its advantages that they can be easily produced into a small-sized form and/or into a thin form.

As shown in FIG. 33, the basic structure of a microstrip line consists of a ground electrode 2 formed on one surface of a dielectric plate 1 and a microstrip line electrode 3 formed on the other surface. In the microstrip line having such a structure shown in FIG. 33, a current is concentrated on edges of the electrode 3 because of the so-called edge effect. This gives rise to a great increase in the conductor loss at the edges. The great majority of the conductor loss occurs in an edge portion within the range of a few microns of the microstrip line. This means that the loss and the maximum allowable power of the transmission line are dominated by the edge effect.

In view of the above, Japanese Unexamined Patent Publication No. 8-321706 discloses a high-frequency transmission line in which the concentration of a current at edges of an electrode is eased. In this high-frequency transmission line, line-shaped conductors with a fixed width are formed so that they are spaced a fixed distance apart from each other and so that they extend in a direction parallel to a signal propagation direction.

Although the transmission line structure including line-shaped conductors having a fixed width and equally spaced from each other is effective to ease the current concentration at edges, the central portion of the transmission line is also made up of line-shaped conductors and thus an increase in the conductor loss occurs due to the reduction in the effective cross-sectional area of the conductor in the central portion of the transmission line.

The above problem occurs not only in microstrip lines or transmission lines, but also in dielectric resonators consisting of an electrode formed on a dielectric.

In view of the above, the object of the present invention is to provide a high-frequency transmission line and a dielectric resonator formed into a small-sized shape and having an effectively reduced loss.

SUMMARY OF THE INVENTION

According to an aspect of the present invention, there is provided a high-frequency transmission line including a dielectric and an electrode, wherein one or more gaps are formed in an edge portion of the electrode along an edge of the electrode. As a result of the formation of the gaps, one or more thin and long electrodes serving as a part of the high-frequency transmission line are formed along the edge of the electrode. A current is divided into the one or more thin electrodes and the edge portion of the main electrode. Because no gaps are formed in the main electrode, the increase in the conductor loss due to the reduction in the cross-sectional area of the conductor is avoided. Thus, it is possible to further reduce the conductor loss compared with the conventional transmission line made up of thin line-shaped conductors with a fixed width over the entire width of the transmission line. In the case where a conductor loss similar to that of the conventional transmission line is allowed, it is possible to achieve a transmission line with a smaller total size and/or a smaller thickness.

In the high-frequency transmission line described above, the electrode is preferably formed into a multilayer structure consisting of thin conductive layers and thin dielectric layers. In the case of a structure consisting of a single conductive layer formed on a dielectric, a current is concentrated within a surface layer of the electrode film due to the skin effect and thus the great majority of the current flows through the surface layer within a skin depth. This causes a high conductor loss. This problem is eased by employing the structure according to the present invention in which the electrode is formed into a multilayer structure consisting of a thin conductive layer and a thin dielectric layer so that the current is divided into a plurality of thin conductive layers thereby easing the current concentration also in a direction across the thickness of the electrode and thus reducing the total conductor loss.

The above-described electrode may be made of a superconductive material. In general, superconductive materials become zero in electric resistance at temperatures equal to or lower than the superconductivity transition temperature. To keep the superconductivity, it is required that the current density should be maintained at a predetermined value lower than the critical current density. If the current density becomes higher than the critical current density, the superconductivity is broken and the material has a finite resistance. According to the present invention, the current concentration in various portions of the electrode are eased and thus it is possible to easily maintain superconductivity even when the electrode has a small width (small cross-sectional area).

According to another aspect of the present invention, there is provided a high-frequency transmission line including a dielectric and an electrode, wherein the electrode is formed into a multilayer structure consisting of thin conductive layers and thin dielectric layers, and an end of the electrode is bent in a direction substantially perpendicular to the surface of the dielectric. In this structure, when a current is going to gather into an edge portion of the electrode due to the edge effect, the current is divided into a plurality of thin conductive layers in the portion of the electrode bent in the direction substantially perpendicular to the surface of the dielectric plate. Furthermore, the effective cross-sectional area of the electrode increases in the edge portion where the edge effect occurs to a greater extent than in other portions and thus the current concentration in each thin conductive layer is also eased.

According to still another aspect of the present invention, there is provided a dielectric resonator employing the above-described high-frequency transmission line as a resonant line thereby achieving a dielectric resonator having high no-load Q (Qo).

According to still another aspect of the present invention, there is provided a dielectric resonator including an electrode formed on the surface of a dielectric or in the inside of a dielectric, wherein one or more gaps are formed in an edge portion of the electrode along an edge of the electrode. In this structure, the current concentration in the edge portions of the electrode is suppressed and thus the total conductor loss decreases. As a result, it is possible to obtain a dielectric resonator having high Qo.

FIGS. 31 and 32 show the attenuation constant $\alpha$(Np/m) simulated for various transmission lines. The simulation was performed at a frequency of 2 GHz under the assumption that the thickness and the relative dielectric constant $\epsilon_r$ of each dielectric plate were 0.1 mm and 10, respectively, and the effective line width was 11 $\mu$m. FIG. 31 shows the simulation result for the case where 1 $\mu$m gaps were formed so that the resultant width of thin line-shaped electrodes became 1 $\mu$m. In the case where gaps are formed so that thin line-shaped electrodes are formed over the entire width of the transmission line, the resultant $\alpha$ becomes 3.59 which is worse than the attenuation constant $\alpha$=2.92 obtained in the conventional transmission line shown in FIG. 31A. On the other hand, if one gap is formed along one edge and another gap is formed along the opposite edge as shown in FIG. 31C, $\alpha$=2.87 is obtained and thus a great improvement in the conductor loss is achieved. If two gaps similar to the above-described gaps are formed in each edge portion as shown in FIG. 31D, then the attenuation constant $\alpha$ becomes 3.15. This result is worse than that for the structure shown in FIG. 31A but better than that for the structure shown in FIG. 31B. In the case where a gap is formed at the center of the electrode as shown in FIG. 31E, although $\alpha$ decreases by an amount corresponding to the reduction in the cross-sectional area of the conductor, $\alpha$ is still better than that obtained in the structure (B).

FIG. 32 shows the result for the case where the gap width is 0.4 $\mu$m and the width of each thin line-shaped electrode is 1.5 $\mu$m. If thin line-shaped electrodes are formed over the entire width of the transmission line as shown in FIG. 32B, $\alpha$ becomes smaller than that obtained in FIG. 31B because the total cross-sectional area is greater than FIG. 31B. However, as can be seen from FIGS. 32C, 32D, and 32E, the present invention can provide a smaller value of $\alpha$ and thus a reduction in the conductor loss.

The present invention also provides a filter including a dielectric resonator of the above-described type and input/output electrodes coupled to the dielectric resonator.

According to still another aspect of the present invention, there is provided a duplexer including a transmission filter and a reception filter each realized using a filter according to the above-described technique, wherein the transmission filter is disposed between a transmission signal input port and an antenna port, and the reception filter is disposed between a reception signal output port and the antenna port, According to still another aspect of the present invention, there is provided a communication device including a high-frequency circuit wherein the high-frequency circuit includes at least one of the above-described high-frequency transmission line the above-described dielectric resonator, the above-described filter, or the above-described duplexer.

BRIEF DESCRIPTION OF THE DRAWINGS

FIGS. 32A to 32E are schematic diagrams illustrating the attenuation constant simulated for high-frequency transmission lines having various structures.

DESCRIPTION OF THE PREFERRED EMBODIMENTS

Figure 1:
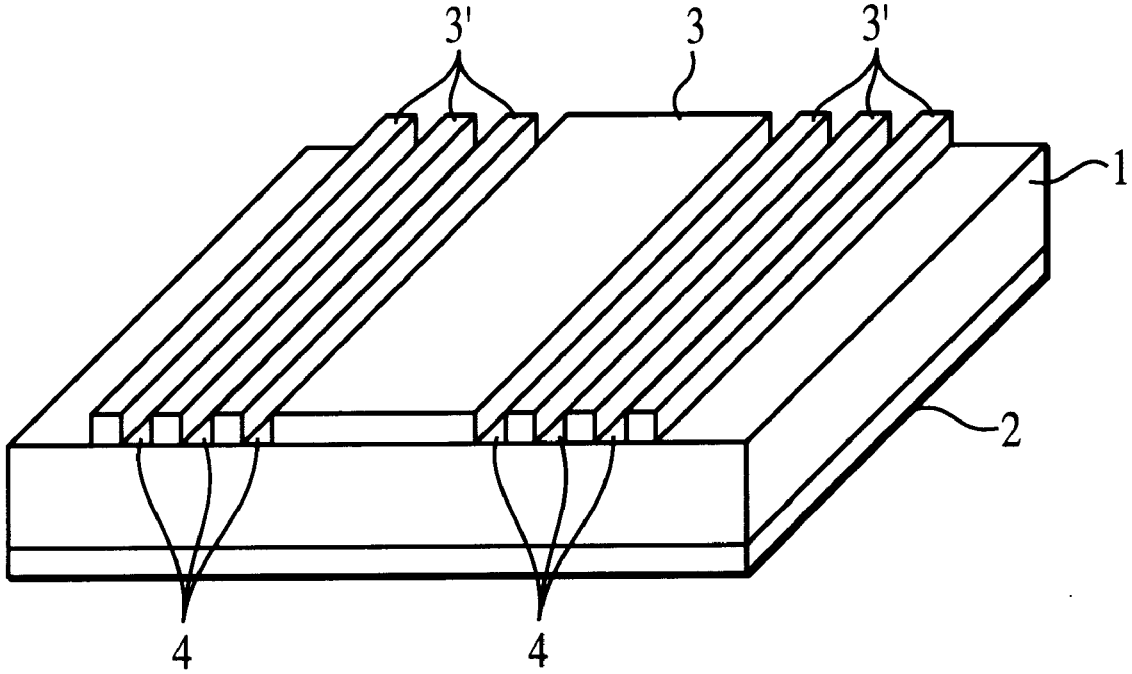
FIG. 1 is a perspective view illustrating the structure of a microstrip line according to a first embodiment of the invention.

A first embodiment of a microstrip line according to the present invention is described below with reference to FIGS. 1 and 2. FIG. 1 is a perspective view of the microstrip line. As shown, the microstrip line includes a ground electrode 2 formed on the lower surface of a dielectric plate 1 and microstrip line electrodes 3 and 3' formed on the upper surface of the dielectric plate 1. In this embodiment, as shown in FIG. 1, a plurality of gaps 4 are formed in the edge portions of the microstrip line electrode 3 so that thin and long electrodes 3' are formed in the edge portions. The microstrip line electrodes 3 and 3' may be produced by means of a thick film printing process. Alternatively, the microstrip line electrodes 3 and 3' may also be produced by forming an electrode film over the entire surface and then forming gaps 4 in the electrode film by means of a proper patterning process such as etching. The strip line electrodes 3 and 3' may be made up of a superconductive thin film.

Figure 2A:
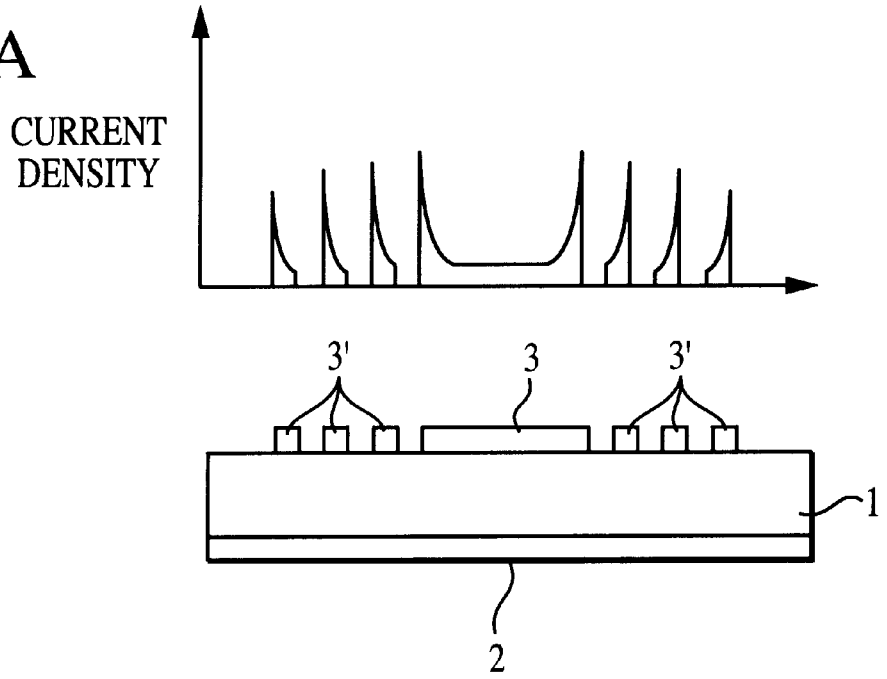
FIGS. 2A and 2B are schematic representations of current density distribution in the microstrip line shown in FIG. 1 and that in a microstrip line according to a conventional technique.
Figure 2B:
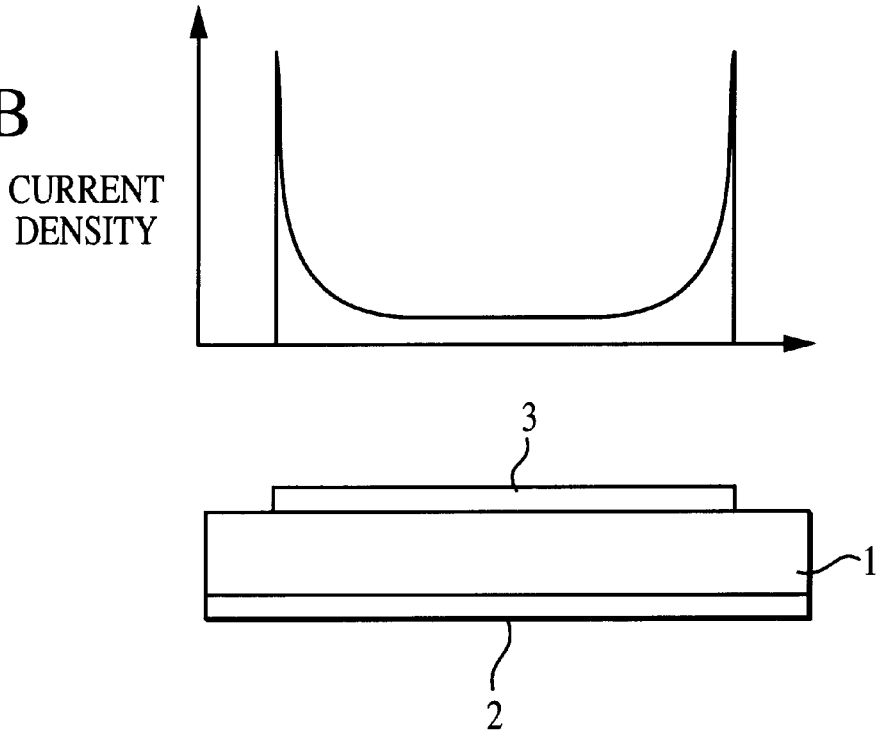
Figure 33:
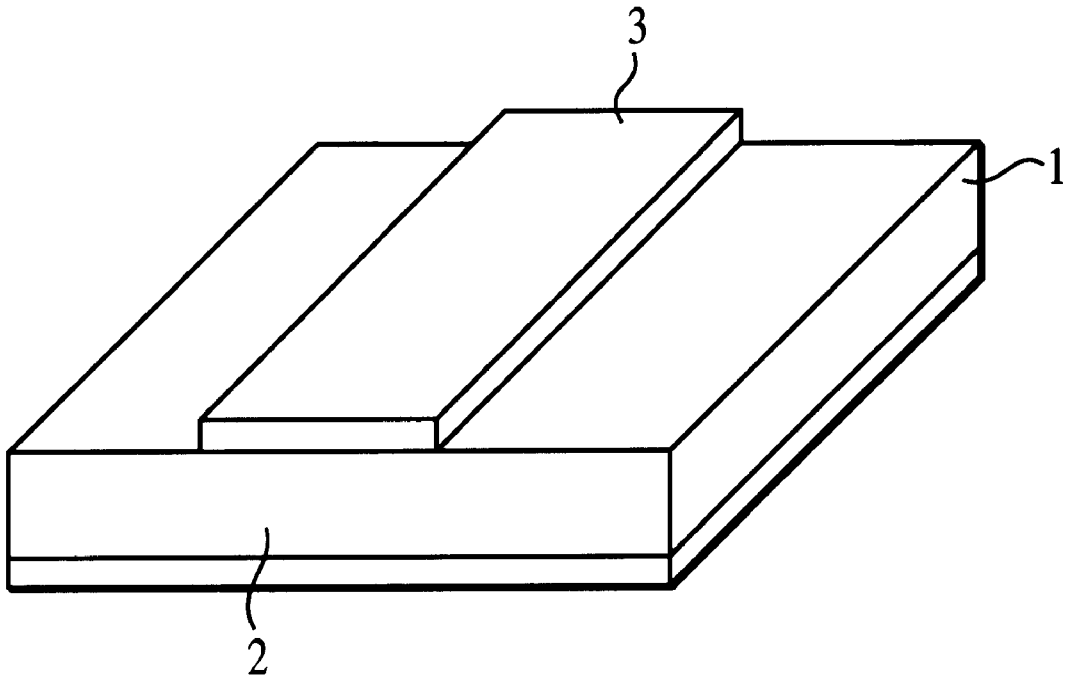
FIG. 33 PRIOR ART
FIG. 33 is a perspective view illustrating the structure of a conventional microstrip line.

FIG. 2 illustrates the current density distribution for both the microstrip line shown in FIG. 1 and the conventional microstrip line shown in FIG. 33. In the structure shown in FIG. 1, as can be seen from FIG. 2A, although current concentrations occur at edges of respective electrodes 3 and 3', the current is divided into a plurality of portions and thus the maximum current density is suppressed. In contrast, in the conventional microstrip line shown in FIG. 2B, a great current concentration occurs at both edges of the electrode 3 and a great conductor loss results from such a great current concentration at the edges.

In the case where the strip line electrodes 3 and 3' are made up of a superconductive thin film, the above-described reduction in the maximum current density achieved in the present invention makes it possible to pass a large current over the entire width of the transmission line as long as the current density does not exceed the critical current density. This makes it possible to realize a small-sized microstrip line capable of dealing with high power. In other words, it is possible to reduce the thickness or the width of the strip line electrodes 3 and 3' so that the microstrip line can be used within the current density range below the critical current density.

Figure 3:
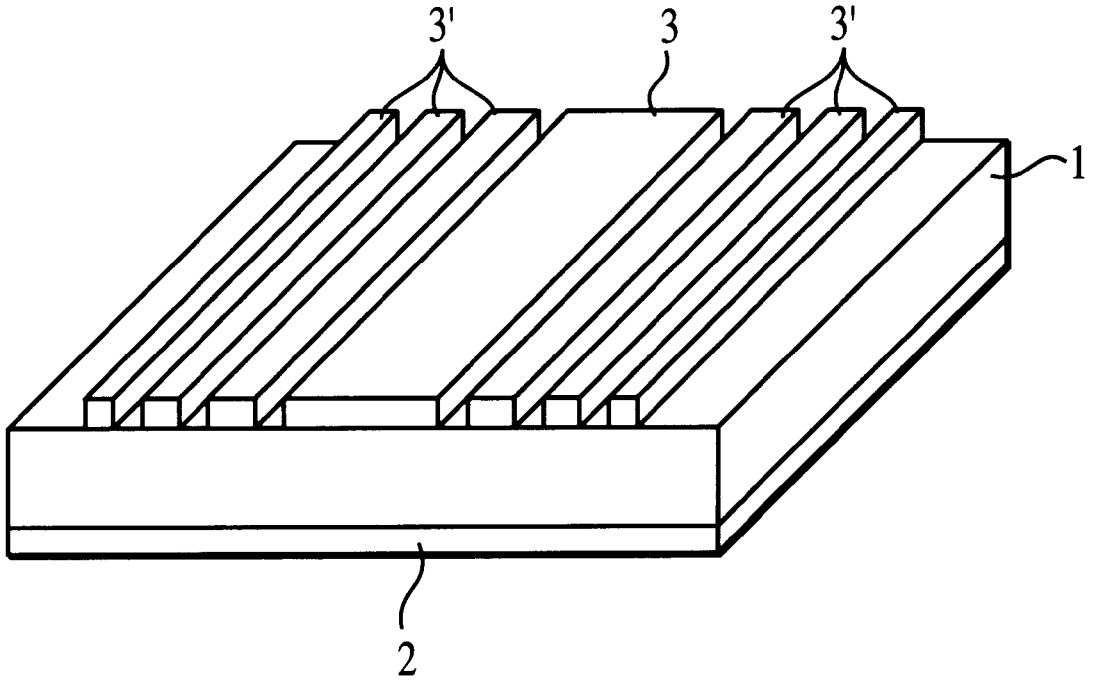
FIG. 3 is a perspective view illustrating the structure of a microstrip line according to a second embodiment of the invention.

FIG. 3 is a perspective view illustrating the structure of a microstrip line according to a second embodiment of the present invention. This microstrip line is similar to that shown in FIG. 1 in that a plurality of gaps are formed along the edges of the microstrip line electrode 3 but different in that electrodes at outer locations have a smaller width and those at inner locations have a greater width. In this structure, a higher density of thin line-shaped electrodes are formed in a portion in which the edge effect occurs to a greater extent thereby leveling the current density distribution using a less number of gaps.

Figure 4:
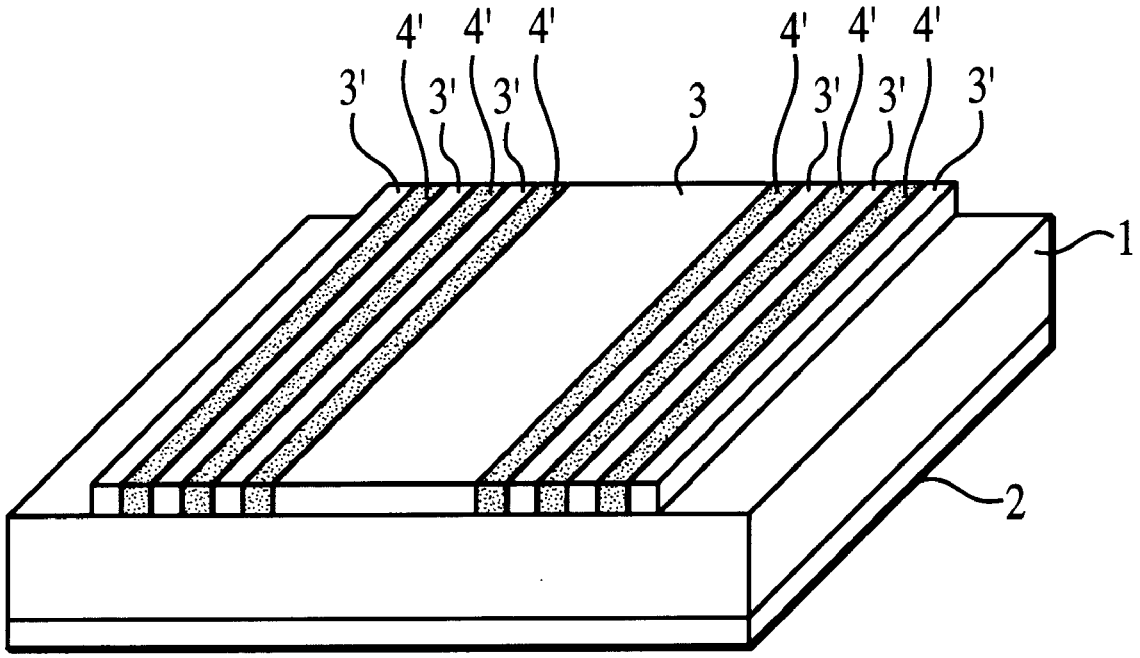
FIG. 4 is a perspective view illustrating the structure of a microstrip line according to a third embodiment of the invention.

FIG. 4 is a perspective view illustrating the structure of a microstrip line according to a third embodiment of the present invention. This microstrip line is obtained by filling the gaps shown in FIG. 1 with a dielectric material 4'. Although a current concentration occurs in edge portions of the electrodes 3 and 3', the total current is divided into a plurality of portions and thus the maximum current density is suppressed.

Figure 5:
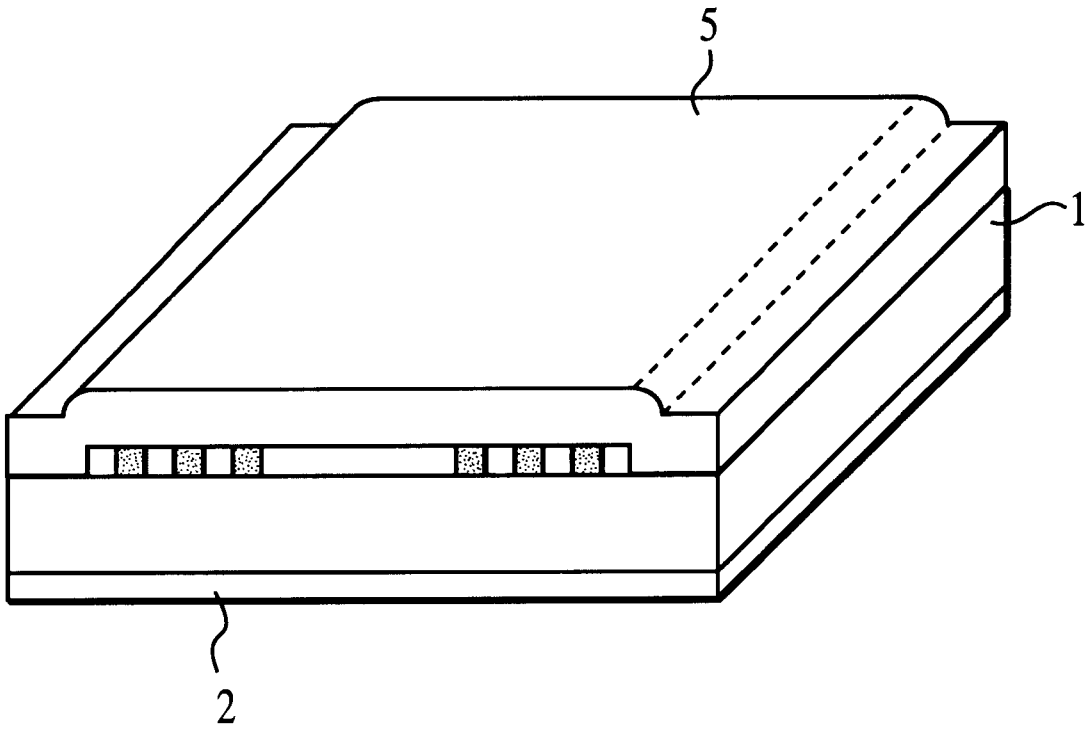
FIG. 5 is a perspective view illustrating the structure of a microstrip line according to a fourth embodiment of the invention.

FIG. 5 is a perspective view of a microstrip line according to a fourth embodiment of the present invention. This microstrip line is obtained by covering the upper surface of the dielectric plate 1 shown in FIG. 1 or 4 with a dielectric 5. In the structure according to the fourth embodiment, coupling between a surface wave mode and a fundamental mode close to a TEM mode is suppressed and thus the loss due to the energy conversion is suppressed.

Figure 6A:
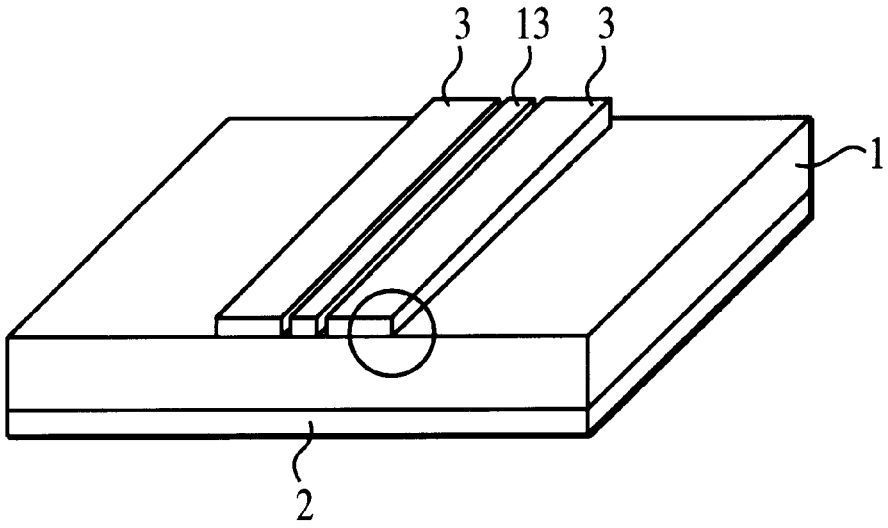
FIGS. 6A and 6B are perspective views illustrating the structure of a microstrip line according to a fifth embodiment of the invention.
Figure 6B:
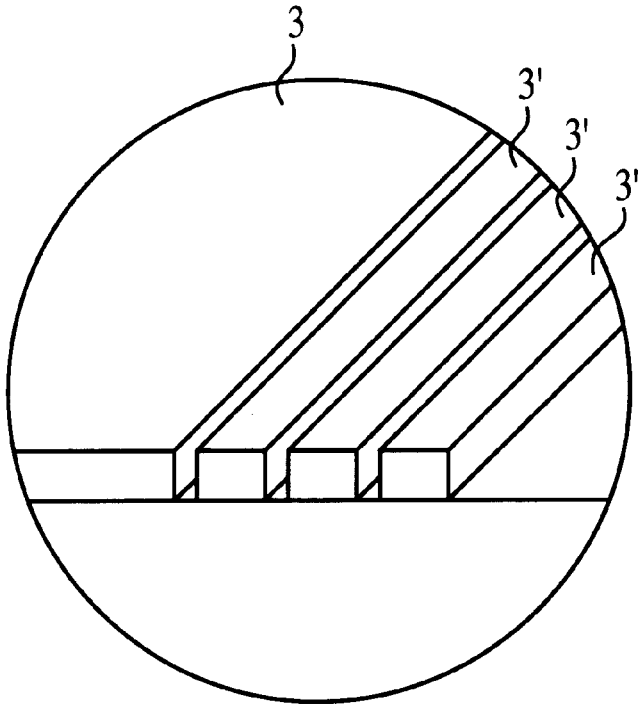

FIG. 6 is a perspective view illustrating the structure of a microstrip line according to a fifth embodiment, wherein the detailed structure of edge portions of a microstrip line 3 is not shown in FIG. 6A. An edge portion enclosed in a circle in FIG. 6A is shown in an enlarged fashion in FIG. 6B. In this embodiment, a microstrip line electrode 13 is disposed at the center, and electrodes 3 are disposed at both sides of the microstrip line electrode 13. Furthermore, thin line-shaped electrodes 3' are disposed at both sides of the electrode 3.

FIGS. 7–14 illustrate transmission lines of the types other than the microstrip line. Although these transmission lines also include gaps formed at locations marked with circles, the detailed structure including gaps in edge portions are not shown in FIGS. 7–14.

Figure 7:
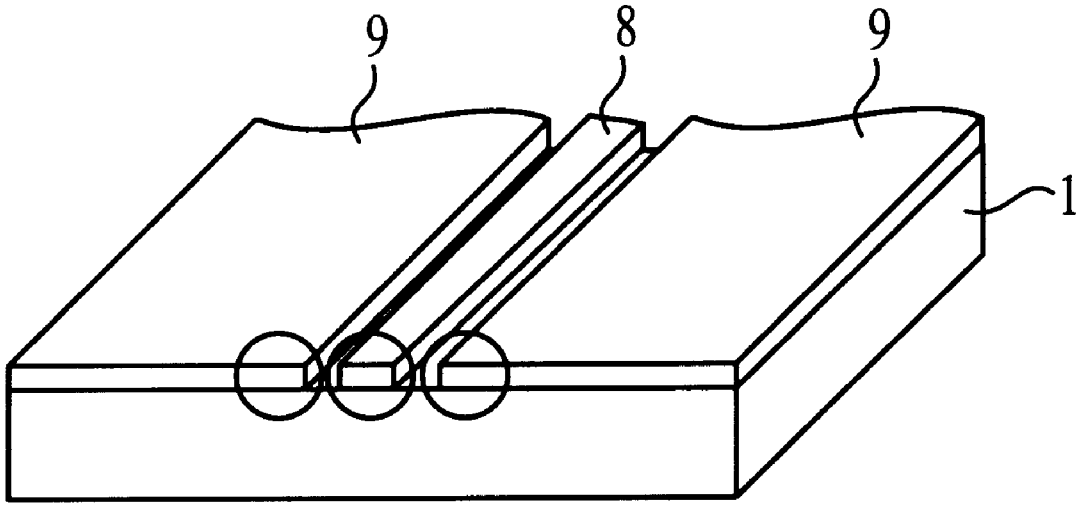
FIG. 7 is a schematic diagram of an embodiment of a coplanar guide according to the invention.

FIG. 7 is a perspective view illustrating an example applied to a coplanar guide. In this structure, as shown in FIG. 7, ground electrodes 9 and a coplanar guide electrode 8 are all formed on the same one surface of a dielectric plate 1. One or more gaps are formed in each portion marked with a circle in the figure where a magnetic field is concentrated, that is, in each of edge portions of the coplanar guide electrode 8 and also in an edge portion, close to the coplanar guide electrode 8, of each ground electrode 9, thereby forming thin line-shaped electrodes such as those shown in FIG. 6B.

Figure 8:
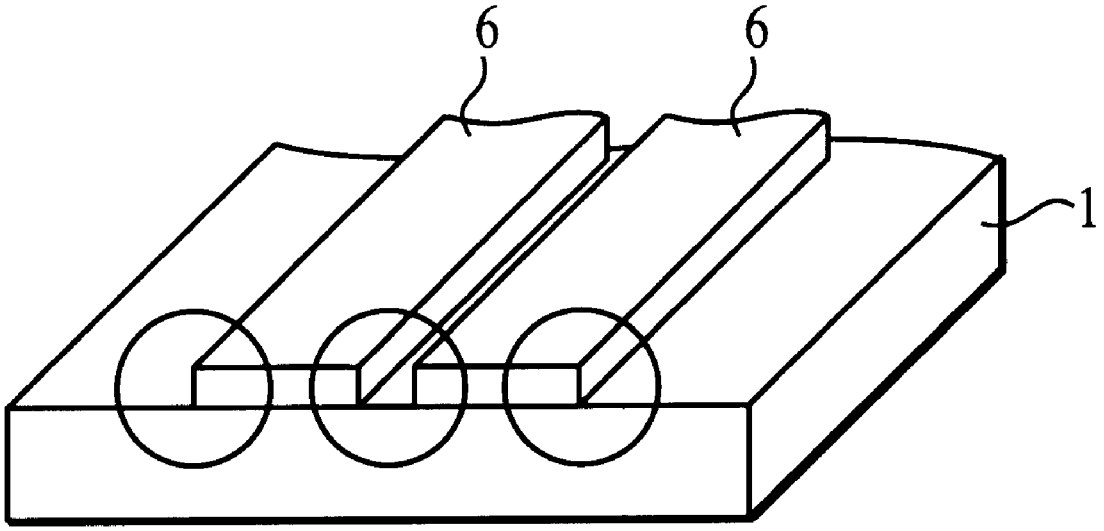
FIG. 8 is a schematic diagram of an embodiment of a coplanar guide including two symmetrical conductors according to the invention.

FIG. 8 is a perspective view illustrating another example applied to a coplanar guide consisting of two symmetric conductors. In this example, as shown in FIG. 8, coplanar guide electrodes are formed on the same one surface of a dielectric plate 1. One or more gaps are formed in both edge portions of each coplanar guide electrode 6 so that thin line-shaped electrodes similar to those shown in FIG. 6B are formed in the edge portions.

Figure 9:
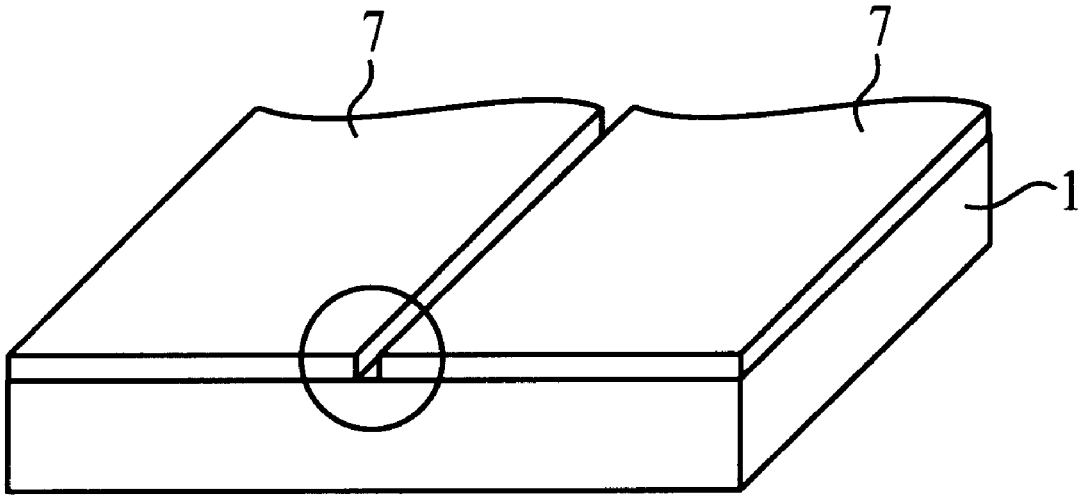
FIG. 9 is a schematic diagram of an embodiment of a slot guide according to the invention.

FIG. 9 is a perspective view illustrating an example applied to a slot guide. Slot guide electrodes 7 are formed on one surface of a dielectric plate 1 as shown in FIG. 9. In this slot guide, one or more gaps are also formed in the slot guide electrode's edge portions spaced from each other by a slot where a magnetic field is concentrated.

Figure 10:
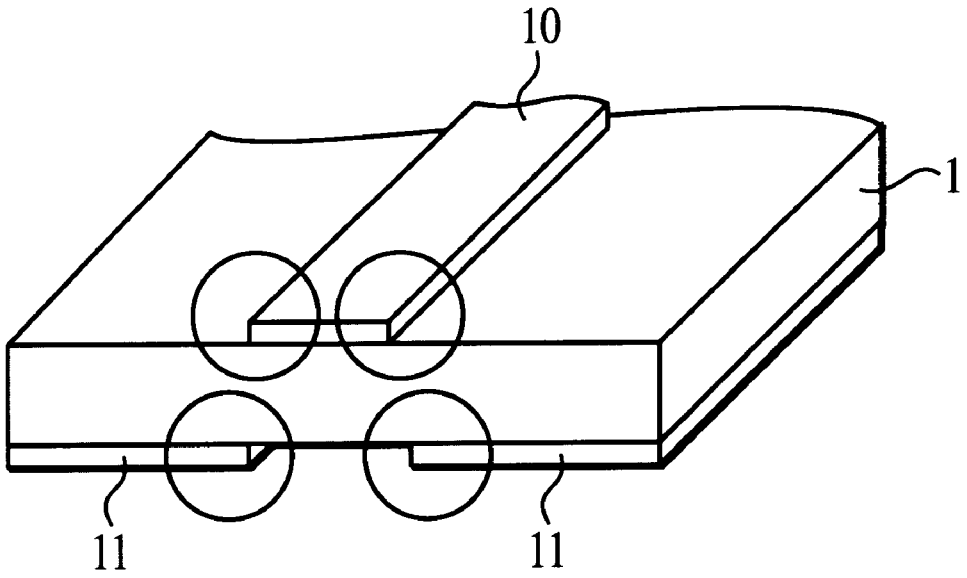
FIG. 10 is a schematic diagram of an embodiment of a suspended strip line according to the invention.

FIG. 10 is a perspective view illustrating an example applied to a suspended strip line. In this example, as shown in FIG. 10, a suspended line electrode 10 is formed on one surface of a dielectric plate 1, and ground electrodes 11 are formed on the opposite surface. One or more gaps are formed in the ground electrode's edge portions spaced from each other by a slot and also in both edge portions of the suspended line electrode 10 so that thin line-shaped electrodes are formed in these edge portions.

Figure 11:
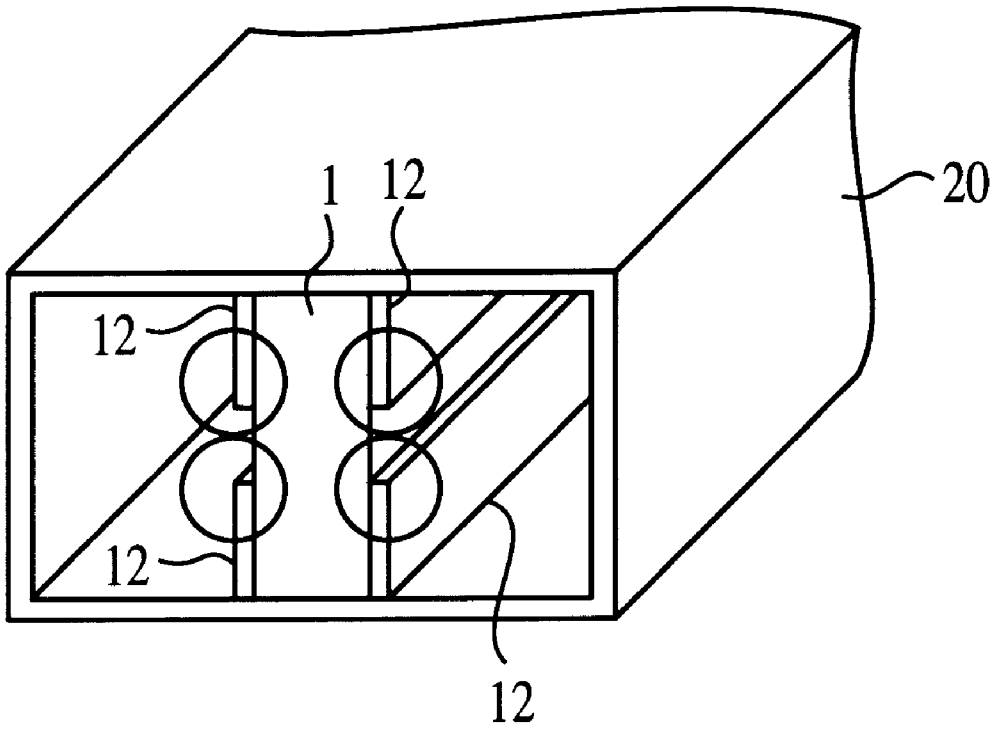
FIG. 11 is a schematic diagram of an embodiment of a fin line according to the invention.

FIG. 11 is a perspective view illustrating an example applied to a fin line. In this example, as shown in FIG. 11, a dielectric plate 1 on which ground electrodes 12 are formed is disposed in the inside of a waveguide 20. In this example, one or more gaps are formed in ground electrode's edge portions spaced from each other by a slot where a magnetic field is concentrated so that thin line-shaped electrodes similar to those shown in FIG. 6B are formed in these edge portions.

Figure 12:
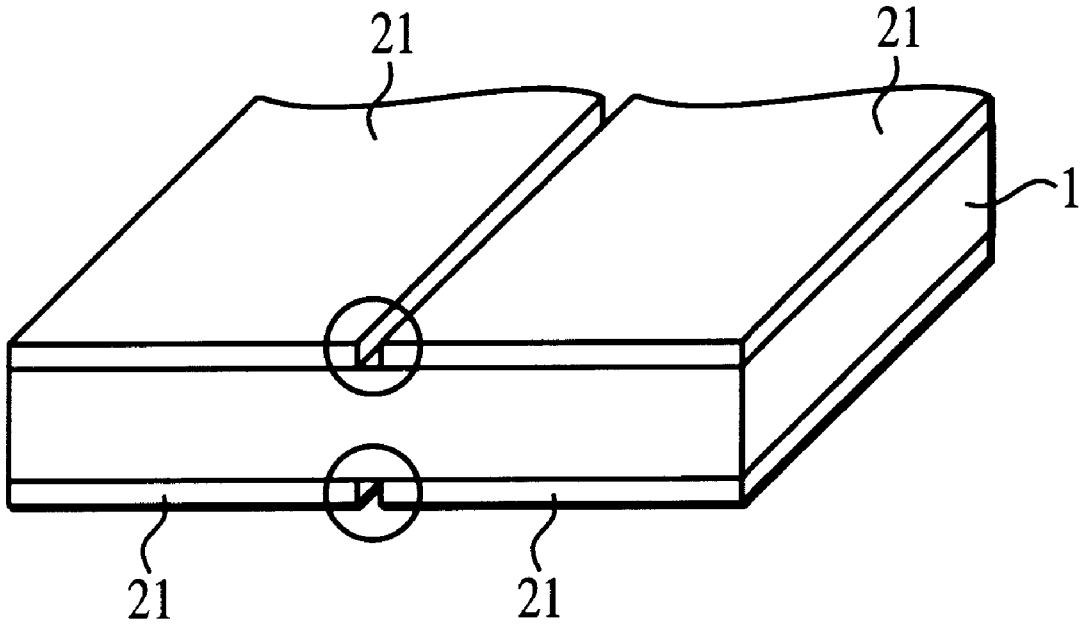
FIG. 12 is a schematic diagram of an embodiment of a PDTL according to the invention.

FIG. 12 is a perspective view illustrating an example applied to a PDTL (plane dielectric transmission line). In this example, as shown in FIG. 12, PDTL electrodes 21 are formed on both surfaces of a dielectric plate 1, and one or more gaps similar to those shown in FIG. 6B are formed in PDTL electrode's edge portions spaced from each other by a slot so that thin line-shaped electrodes are formed in these edge portions.

Figure 13A:
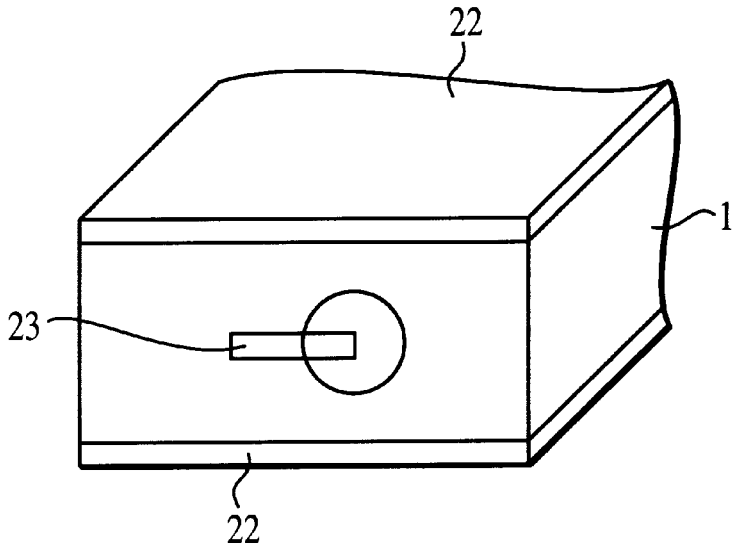
FIGS. 13A and 13B are schematic diagrams of an embodiment of a strip line according to the invention.
Figure 13B:
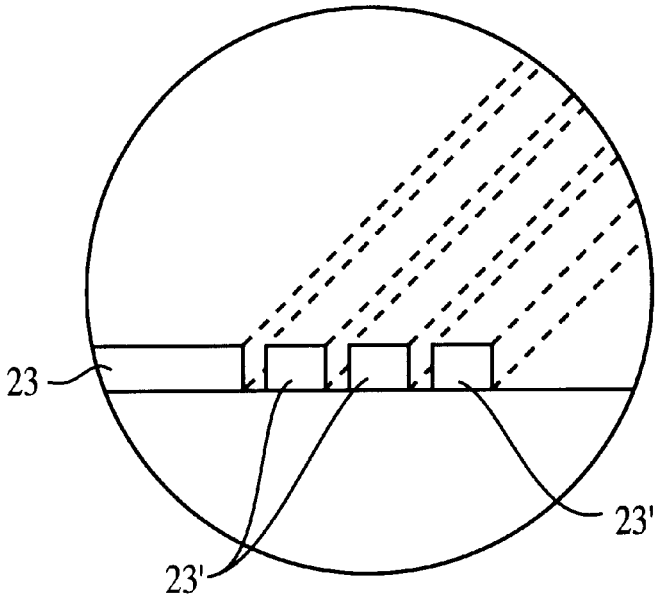

FIG. 13 is a schematic diagram illustrating an example applied to a strip line, wherein a perspective view is given in FIG. 13A and an enlarged fragmentary view is given in FIG. 13B. In this example, as shown in FIG. 13, ground electrodes 22 are formed on both surfaces of a dielectric plate 1 and a strip line electrode 23 is formed in the inside of the dielectric plate 1. A plurality of gaps are formed in each of both edge portions of the strip line electrode 23 so that thin line-shaped electrodes 23' are formed in the respective edge portions as shown in FIG. 13B.

Figure 14:
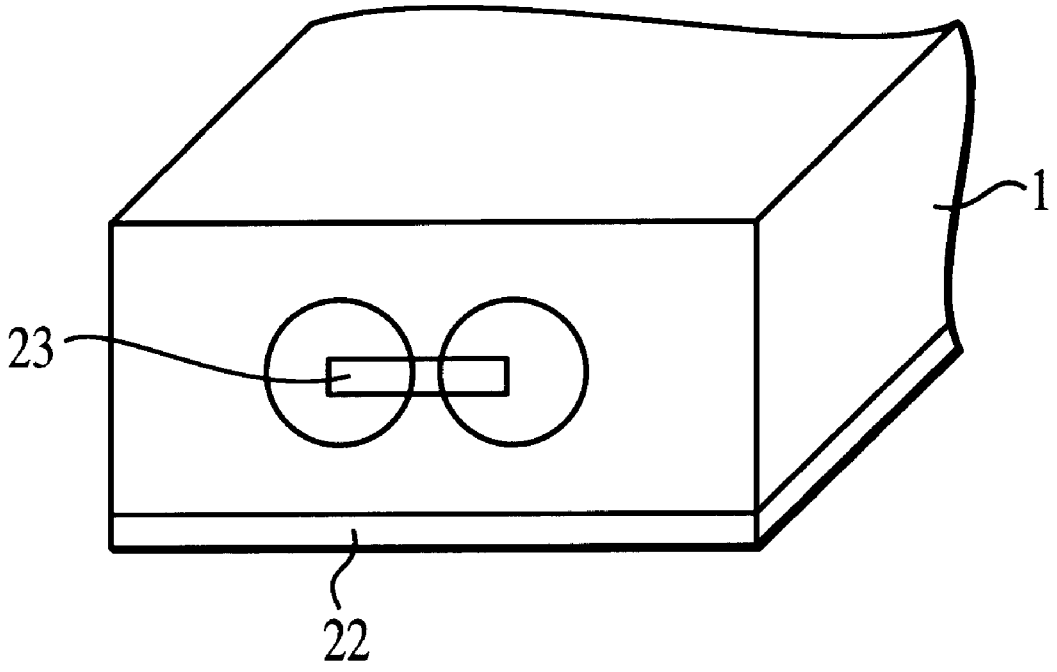
FIG. 14 is a schematic diagram of an embodiment of a modified strip line according to the invention.

FIG. 14 is a perspective view illustrating a modified structure of a strip line. In this strip line, a ground electrode 22 is formed on one surface of a dielectric plate 1 and a strip line electrode 23 is disposed in the inside of the dielectric plate 1. The strip line electrode 23 is formed into a shape similar to that shown in FIG. 13.

Figure 15A:
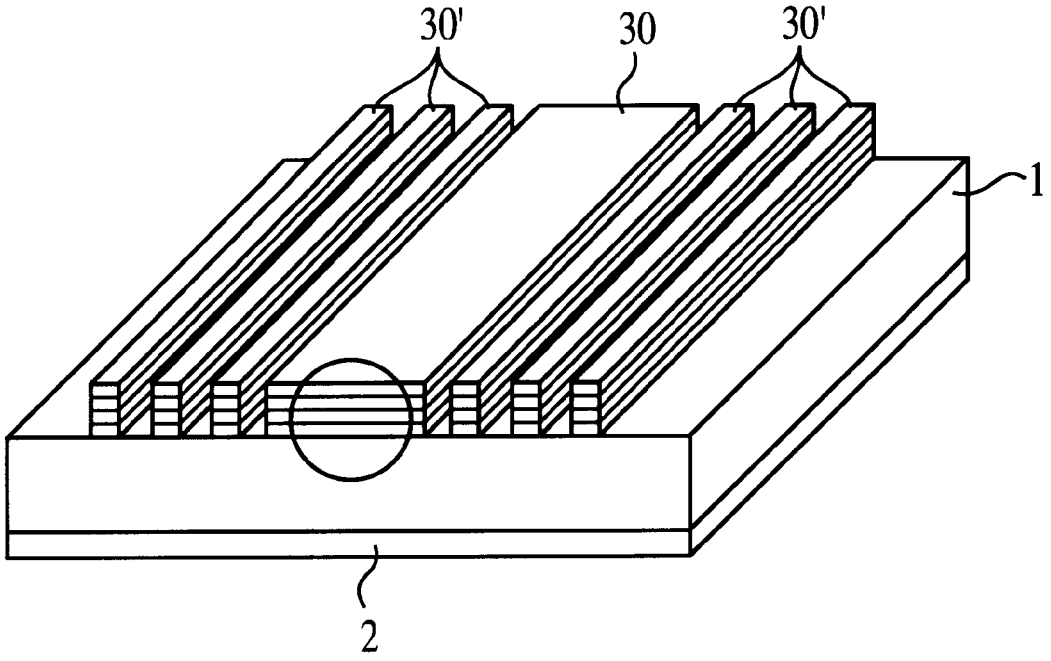
FIGS. 15A and 15B are schematic diagrams illustrating an example using a multilayer thin-film electrode.
Figure 15B:
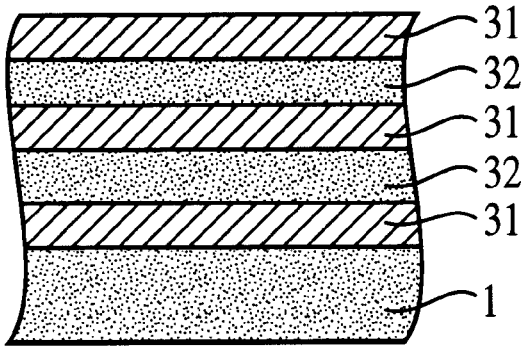
Figure 16A:
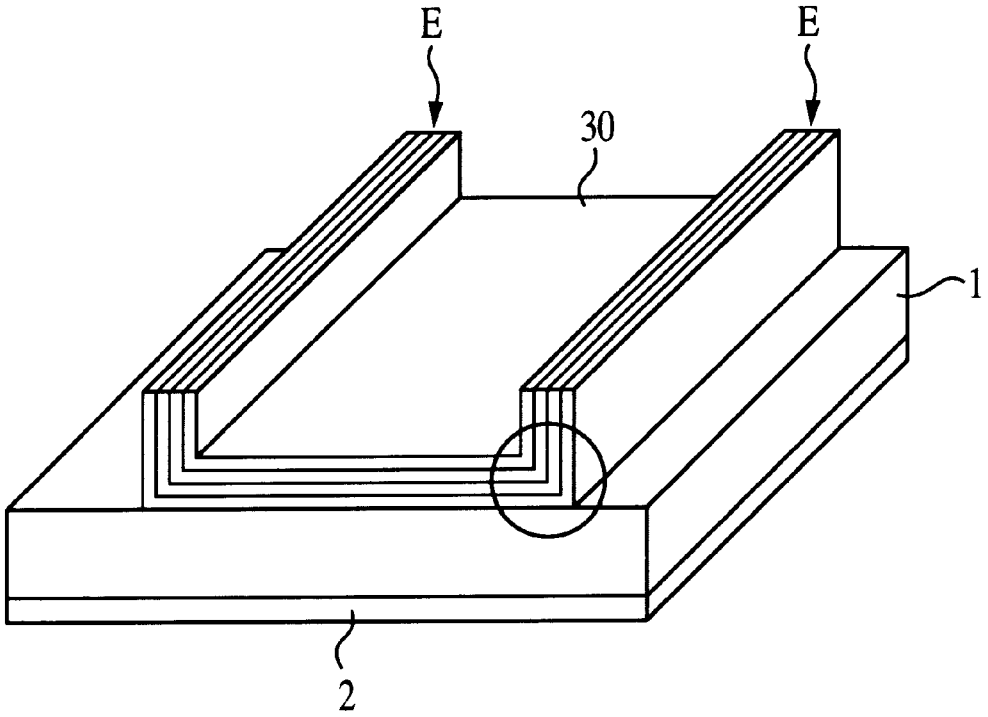
FIGS. 16A and 16B are schematic diagrams illustrating another example using a multilayer thin-film electrode.
Figure 16B:
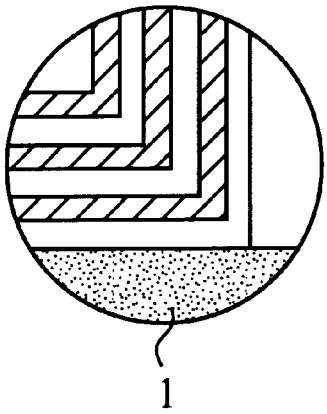

Referring now to FIGS. 15 and 16, examples using a thin multilayer film electrode are described below.

FIG. 15 is a schematic diagram illustrating an example applied to a microstrip line wherein FIG. 15A is a perspective view and FIG. 15B is a fragmentary cross-sectional view of FIG. 15A. In this example, as shown in FIG. 15, a single-layer ground electrode 2 is formed on one surface of a dielectric plate 1 and thin multilayer film electrodes 30 and 30' are formed on the opposite surface of the dielectric plate 1. Each multilayer film electrode is made up of a multilayer film consisting of a conductive thin-film layer 31 and a dielectric thin-film layer 32 as shown in FIG. 15B. Gaps are formed in edge portions of the microstrip line electrode so that thin line-shaped electrodes 30' are formed therein so that the current concentrated in the edge portion is divided in a direction parallel to the surface of the dielectric plate 1. Furthermore, because the entire electrode is formed into a multilayer thin film structure, the current concentration due to the skin effect in a direction across the thickness of the electrode is also suppressed.

FIG. 16 illustrates another example also using a multilayer thin-film electrode. In this example, a single-layer ground electrode 2 is formed on one surface of a dielectric plate 1 and a multilayer thin-film electrode 30 bent at both edges is formed on the opposite surface of the dielectric plate 1. The edge portions of the multilayer thin-film electrode 30 are bent into a direction perpendicular to the dielectric plate 1 as denoted by E in FIG. 16. In this structure, when a current is going to gather in the edge portions of the multilayer thin-film electrode 30 due to the edge effect, the edge portions of the multilayer thin film extending in the direction perpendicular to the dielectric plate 1 cause the current to be divided into the plurality of thin film layers. Furthermore, because the electrode has an effectively greater cross-sectional area in the edge portions where the edge effect occurs to a greater extent than in other portions, the current concentration in each thin film layer is also suppressed.

Referring now to FIGS. 17–21, examples of dielectric resonators including a resonant line realized by a high-frequency transmission line according to any of the above-described techniques are described below.

Figure 17:
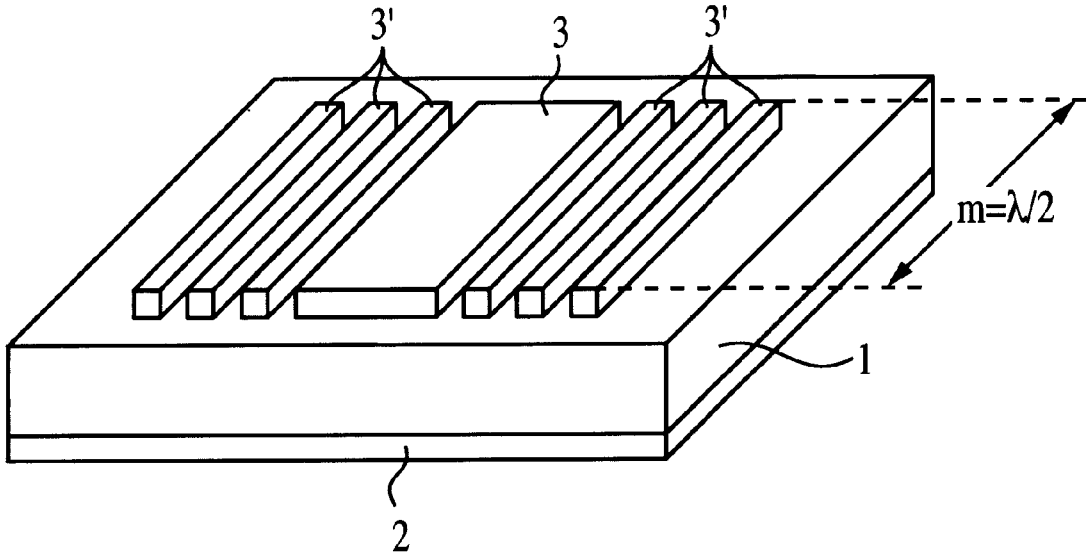
FIG. 17 is a schematic diagram of an embodiment of a 1/2-$\lambda$ transmission line resonator according to the invention.

FIG. 17 is a perspective view illustrating the structure of a 1/2-λ transmission line resonator. In this resonator, a ground electrode 2 is formed on one surface of a dielectric plate 1 and microstrip line electrodes 3 and 3' are formed on the other surface. The length m from one open end to the opposite open end of the microstrip line electrodes 3 and 3' is selected to become equal to λ/2 or an integral multiple of λ/2 so that the structure acts as a resonator whose both ends are open.

Figure 18:
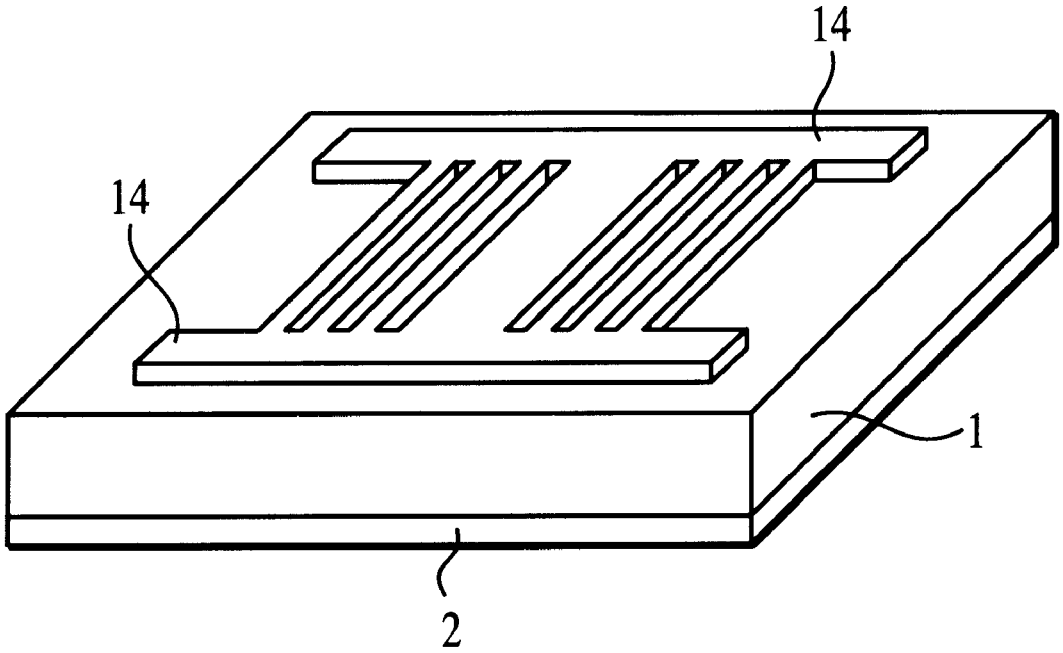
FIG. 18 is a schematic diagram of an embodiment of a snap impedance resonator according to the invention.

FIG. 18 is a perspective view illustrating an example applied to a snap impedance resonator. This resonator is obtained by forming snap impedance electrodes 14 at open ends of the electrode of the resonator shown in FIG. 17. In this structure, the length of the electrode is smaller than that of a microstrip line resonator for the same resonance frequency. This makes it possible to form a dielectric resonator in a limited area.

Figure 19A:
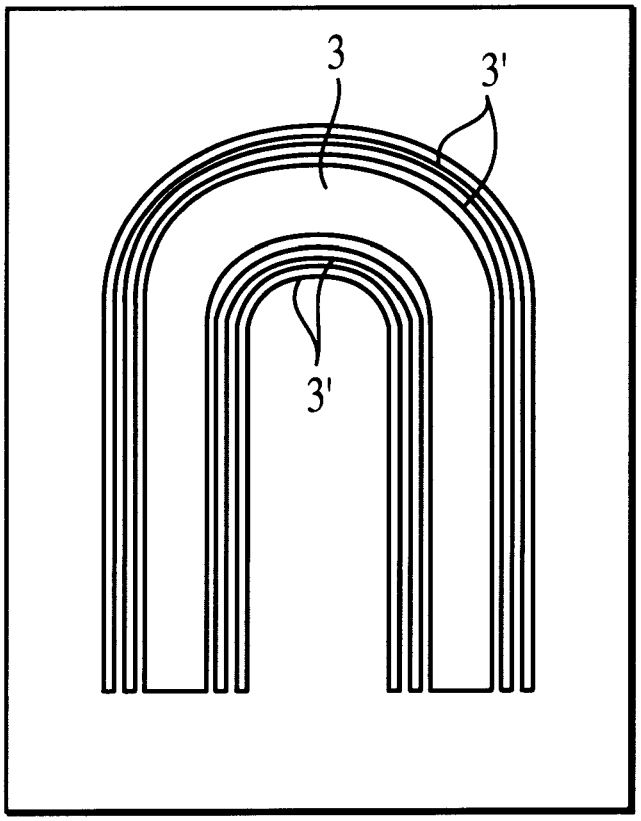
FIGS. 19A and 19B are schematic diagrams of an embodiment of a hairpin type resonator according to the invention.
Figure 19B:
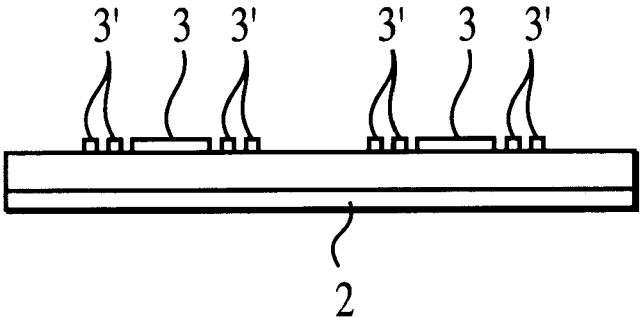

FIG. 19 illustrates a plan view and a cross-sectional view of a hairpin resonator. This resonator can be obtained by bending the microstrip line electrodes 3 and 3' shown in FIG. 17 into a hairpin shape.

Figure 20:
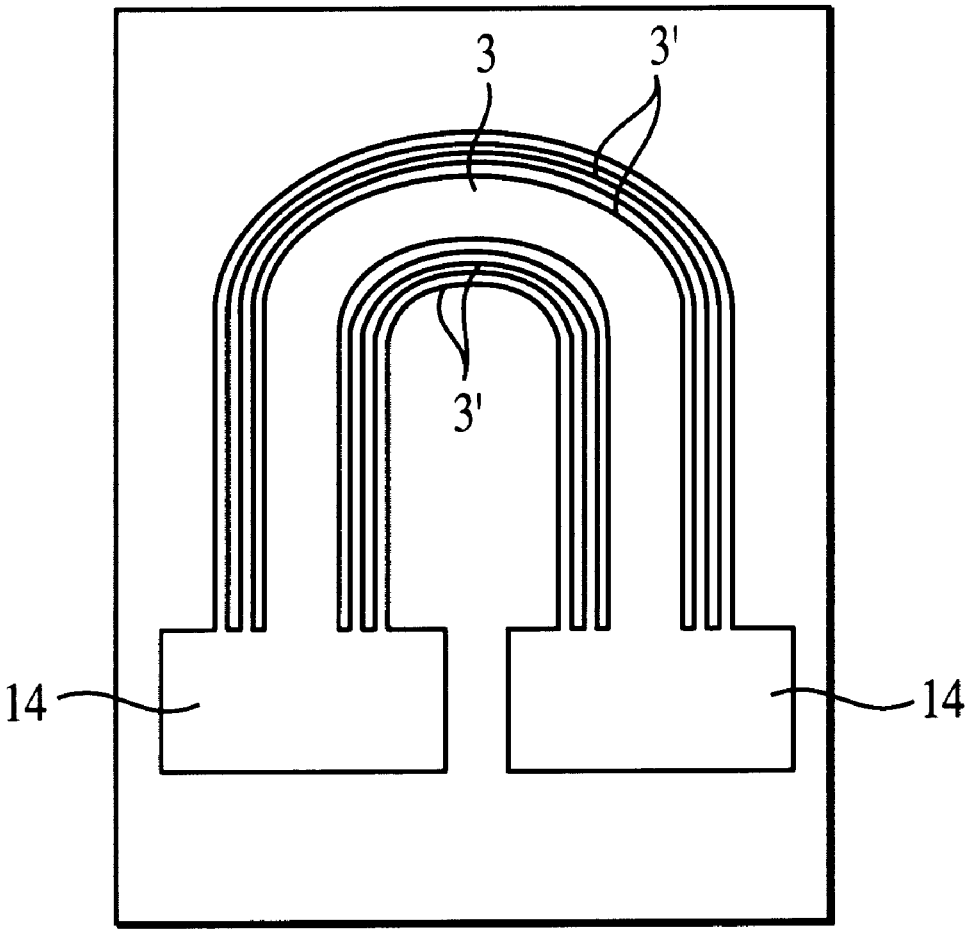
FIG. 20 is a schematic diagram of an embodiment of a hairpin type snap impedance resonator according to the invention.

FIG. 20 illustrates an example applied to a hairpin snap impedance resonator. This resonator can be obtained by forming a snap impedance electrode 14 at both open ends of the electrode shown in FIG. 19.

Figure 21:
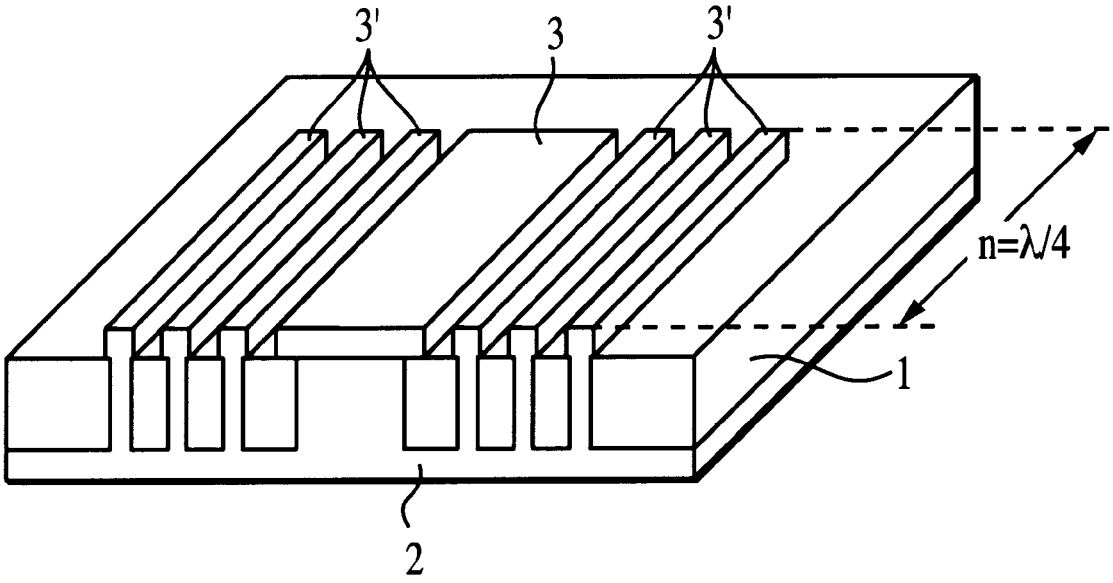
FIG. 21 is a schematic diagram of an embodiment of a 1/4-$\lambda$ transmission line resonator according to the invention.

FIG. 21 illustrates an example applied to a 1/4-λ transmission line resonator. A ground electrode 2 is formed on one surface of a dielectric plate 1 and microstrip line electrodes 3 and 3', with a length n equal to λ/4 or an odd multiple of λ/4, are formed on the opposite surface. One end of each electrode is connected to the ground electrode 2. In this structure, the microstrip line electrode acts as a 1/4-λ transmission line resonator.

Figure 22:
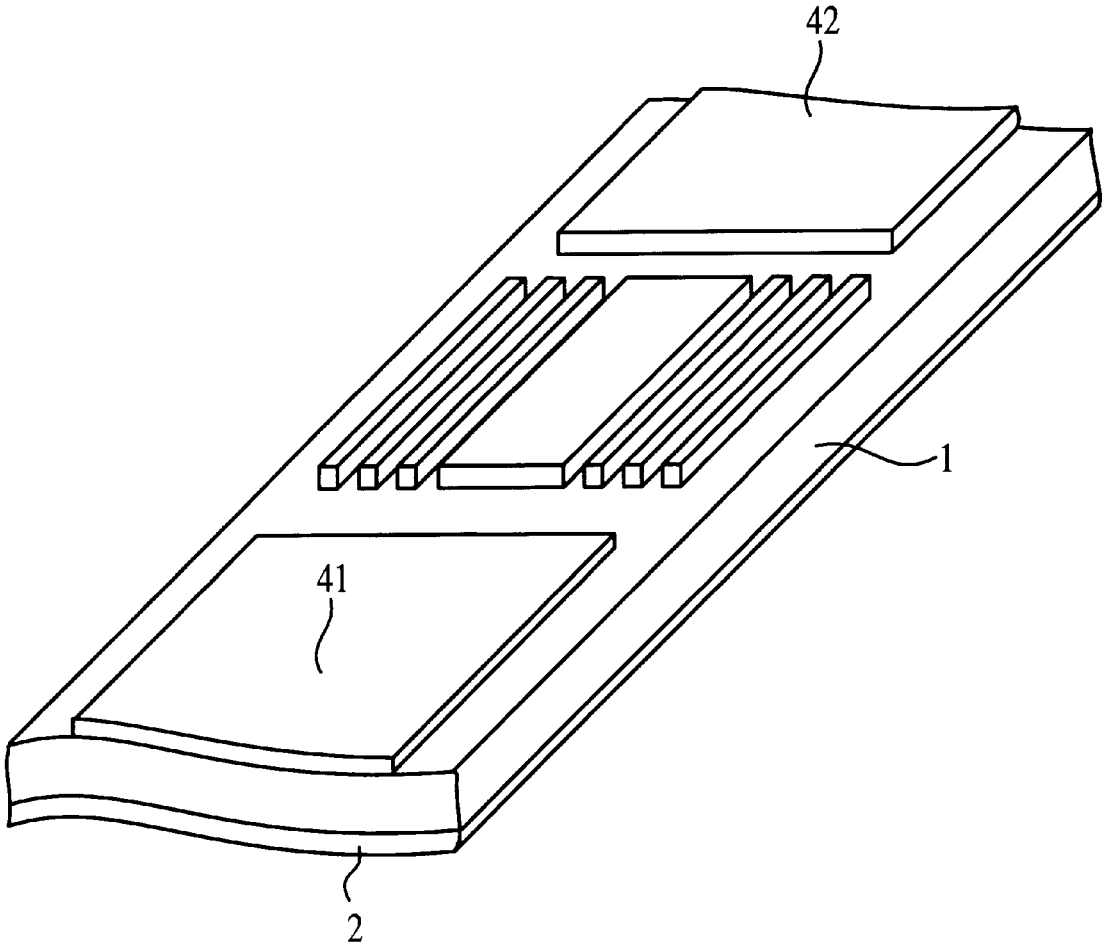
FIG. 22 is a schematic diagram illustrating the structure of a filter.

FIG. 22 is a perspective view illustrating an example of a filter obtained by adding input/output terminals to the 1/2-λ transmission line resonator shown in FIG. 17. If input/output electrodes 41 and 42 coupled to the 1/2-λ transmission line resonator are formed at locations closely spaced from the open ends of the resonator electrode as shown in FIG. 22 so that the input/output terminals 41 and 42 are coupled with the 1/2-λ transmission line resonator, then the resultant structure can be used as a filter.

Referring now to FIGS. 23–28, examples of dielectric resonators obtained by forming resonator electrodes on a dielectric plate or a dielectric pole are shown.

Figure 23A:
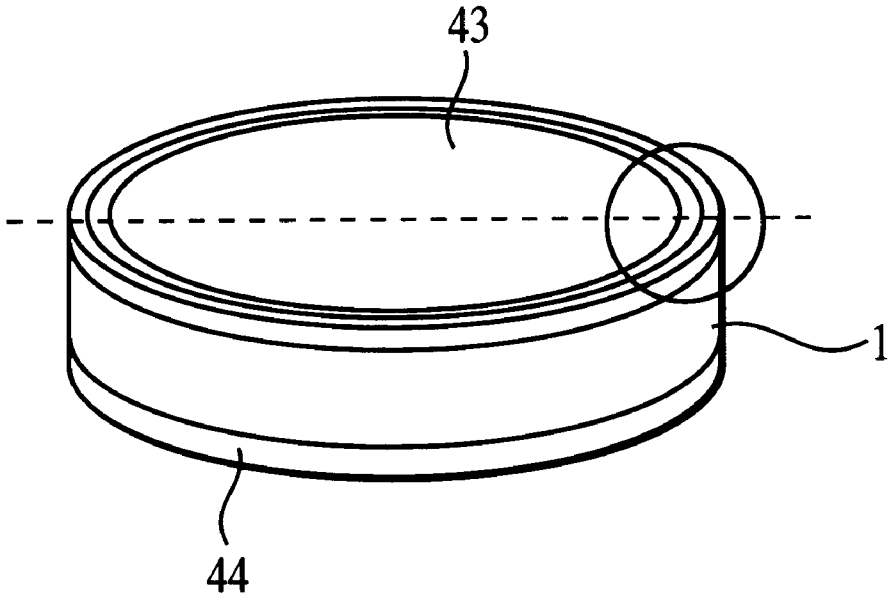
FIGS. 23A and 23B are schematic diagrams of an embodiment of an open circular TM mode resonator.

FIG. 23 illustrates a perspective view and an enlarged cross-sectional view of an open circular TM mode resonator. In this resonator, as shown in FIG. 23, circular-shaped resonator electrodes 43 and 44 are disposed on the opposite surfaces, respectively, of a dielectric plate 1. Furthermore, gaps 45 are formed in the edge portion of each resonator electrodes 43 and 44 so that thin line-shaped electrodes 43' are formed in the edge portion. In this structure, the current concentration in the edge portions of the resonator electrodes 43 and 44 is suppressed. As a result, the conductor loss decreases and thus Qo of the resonator increases.

Figure 23B:
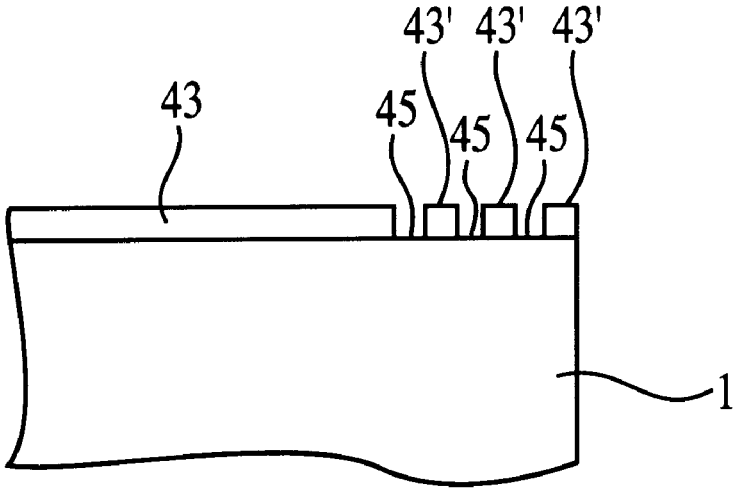
Figure 24:
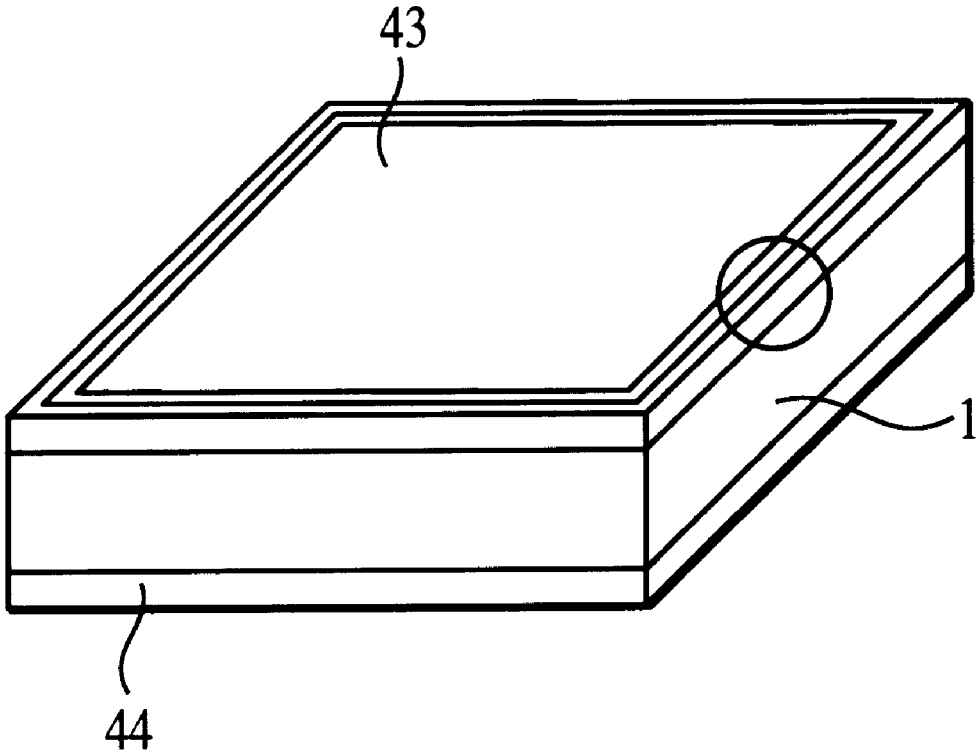
FIG. 24 is a schematic diagram of an embodiment of an open rectangular TM mode resonator.

FIG. 24 is a perspective view of an open rectangular TM mode resonator. In this resonator, rectangular-shaped resonator electrodes 43 and 44 are disposed on the opposite surfaces, respectively, of a dielectric plate 1. Except for the above, the structure of this resonator is similar to that shown in FIG. 23.

Figure 25:
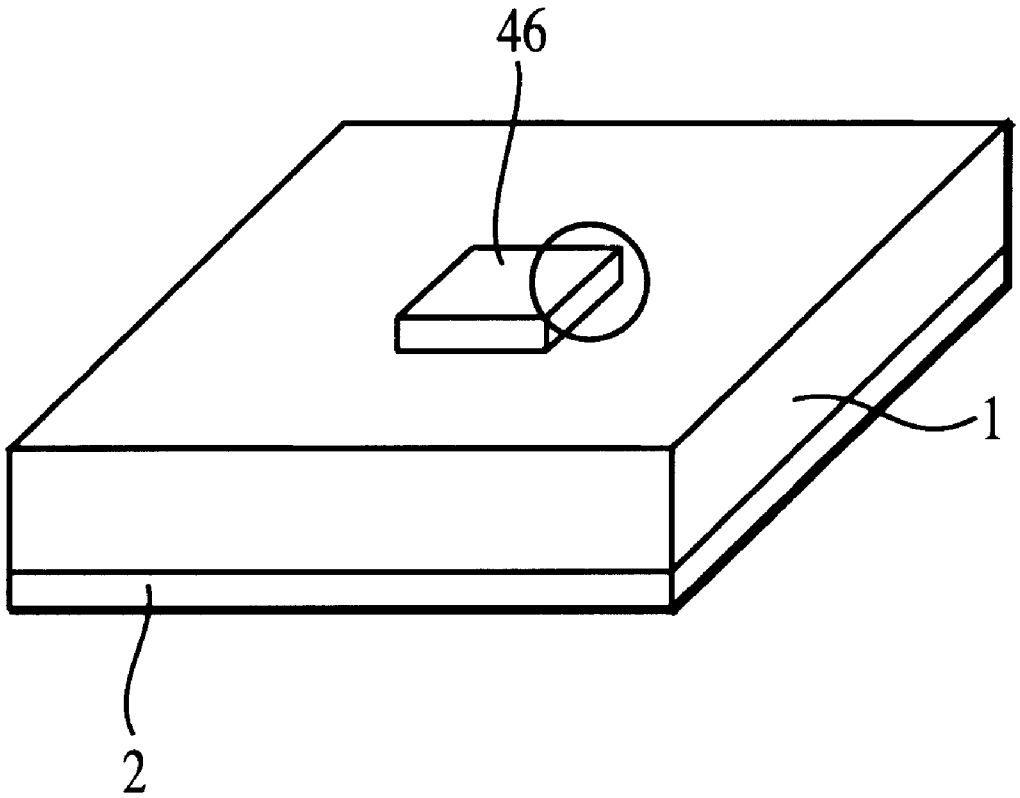
FIG. 25 is a schematic diagram of an embodiment of a rectangular strip line resonator.

FIG. 25 is a perspective view of a rectangular strip line resonator. In this resonator, as shown in FIG. 25, a ground electrode 2 is formed on one surface of a dielectric plate 1 and a rectangular-shaped resonator electrode 46 is formed on the other surface. One or more gaps similar to those shown in FIG. 23B are formed in edge portions of the resonator electrode 46 so that thin line-shaped electrodes are formed in the edge portions.

Figure 26:
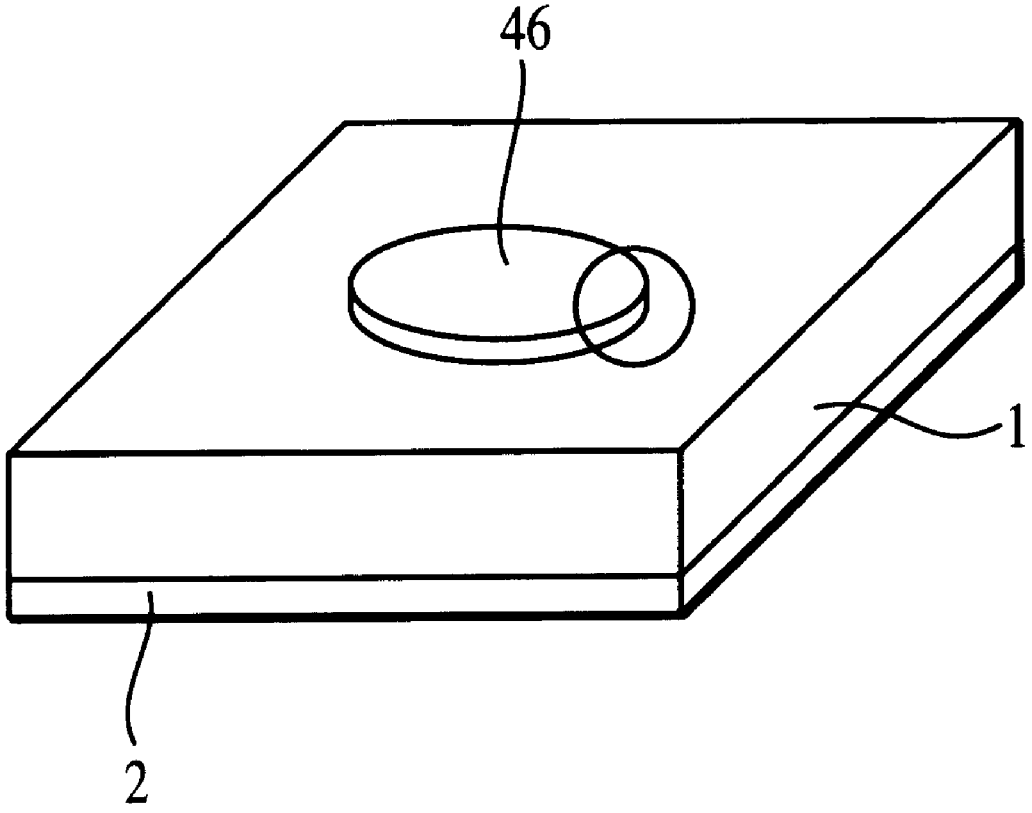
FIG. 26 is a schematic diagram of an embodiment of a circular strip line resonator.

FIG. 26 illustrates a circular strip line resonator. In this resonator, a circular-shaped resonator electrode 46 is formed on one surface of a dielectric plate 1. Except for the above, the structure of this resonator is similar to that shown in FIG. 25.

FIG. 27 is a partially cut-away perspective view of an open circular dielectric resonator disposed in a cavity. In FIG. 27, reference numeral 48 denotes cylindrical-shaped dielectric poles. A resonator electrode 43 is disposed between these two dielectric poles, and electrodes 44 are disposed on the outer end faces of the respective dielectric poles. The assembly of these elements is disposed in the inside of a cavity (shielded cavity) 47. The resonator electrode 43 may be made up of a single layer or a combination of two electrodes formed on the inner end faces of the two dielectric poles 48, respectively. The electrodes 44 formed on the outer end faces of the two dielectric poles 48 may or may not be electrically connected to the wall of the cavity 47.

Figure 27A:
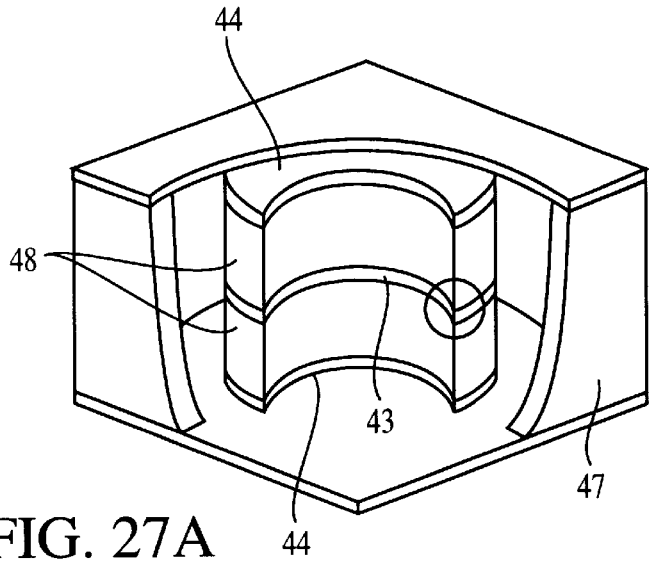
FIGS. 27A to 27E are schematic diagrams of an embodiment of an open circular dielectric resonator.
Figure 27C:
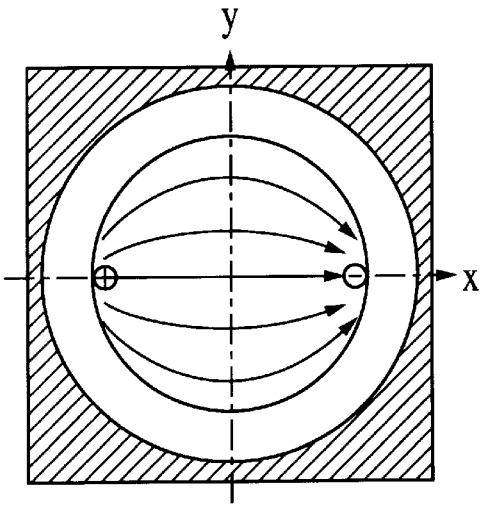
Figure 27B:
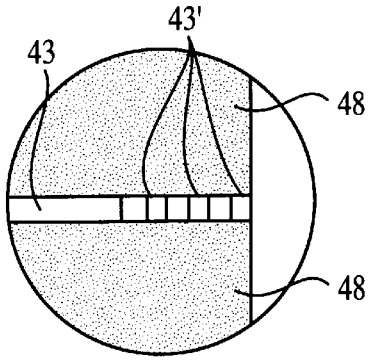
Figure 27D:
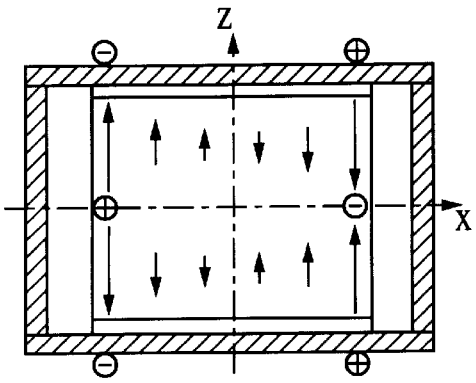
Figure 27E:
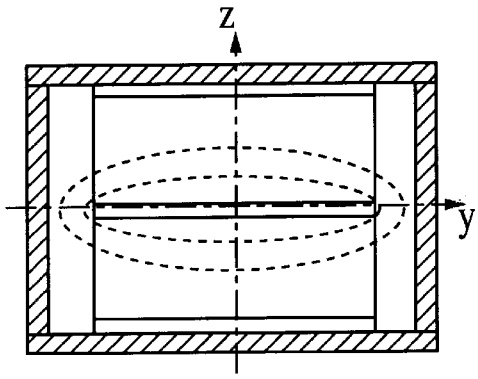

FIG. 27C illustrates the current distribution in the resonator electrode, FIG. 27D illustrates the electric distribution in the resonator, and the FIG. 27E illustrates the magnetic field distribution in the resonator. As can be seen from these figures, the great majority of energy of the resonant electromagnetic field is concentrated within the dielectric pole, and the electromagnetic field distributions in the respective dielectric poles are similar to the distribution in the circular TM110 mode. As a result, the current is concentrated in the edge portions of the resonator electrode 43.

FIG. 27B is an enlarged cross-sectional view of the part enclosed in a circle in FIG. 27A. As shown in FIG. 27B, a plurality of gaps are formed in the edge portion of the resonator electrode 43 so that thin line-shaped electrodes 43' are formed in the edge portion thereby suppressing the current concentration in the edge portion of the resonator electrode 43.

Figure 28A:
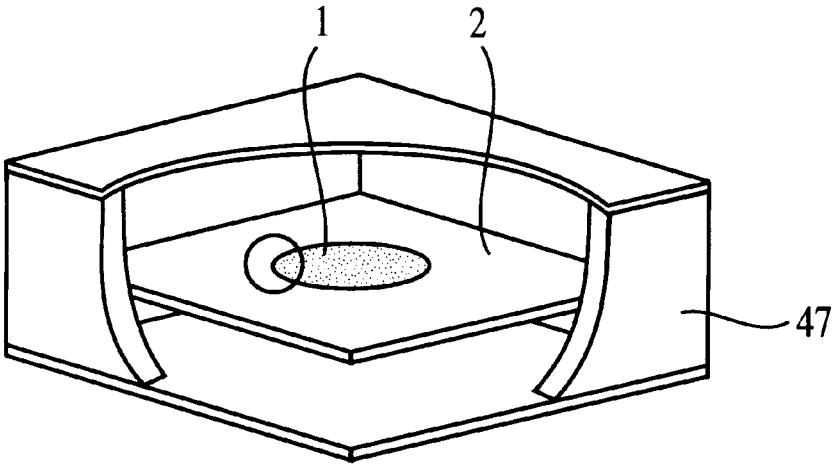
FIGS. 28A and 28B are schematic diagrams of an embodiment of a TE-mode dielectric resonator.
Figure 28B:
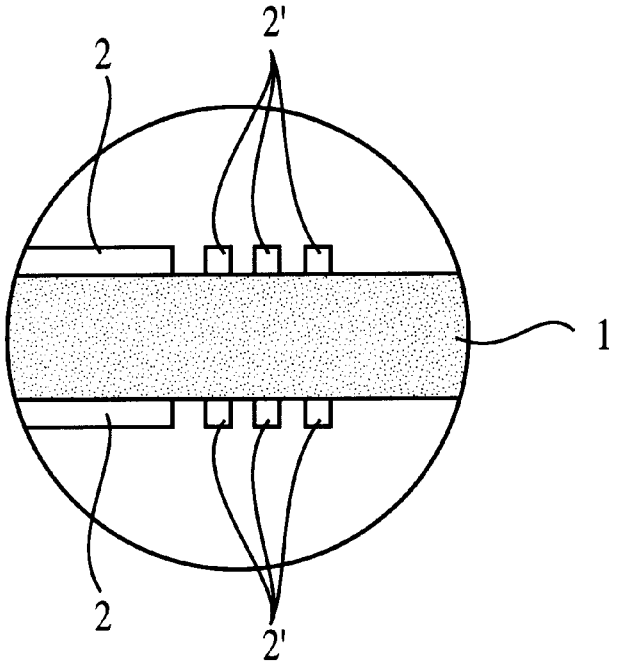

FIG. 28 illustrates an example of a TE-mode dielectric resonator. In FIG. 28, reference numeral 1 denotes a rectangular-shaped dielectric plate having a size corresponding to the size of a cavity 47. Ground electrodes 2 each having a circular opening formed at the center are formed on both surfaces of the dielectric plate 1. A TE-mode resonator is formed in the region of the dielectric plate which is not covered with the ground electrodes 2 (at a location where openings are formed). A plurality of gaps are formed in the edge portion, immediately adjacent to the non-electrode portion, of each ground electrode 2 so that thin line-shaped electrodes 2' are formed in the edge portion thereby suppressing the current concentration in the edge portion adjacent to the opening of the ground electrodes 2.

FIG. 29 illustrates a duplexer comprising a resonant transmission line formed on a dielectric plate.

Figure 29A:
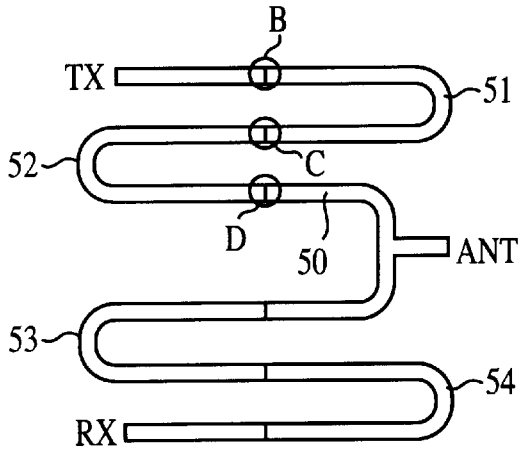
FIGS. 29A to 29D are schematic diagrams illustrating the structure of a duplexer.
Figure 29B:
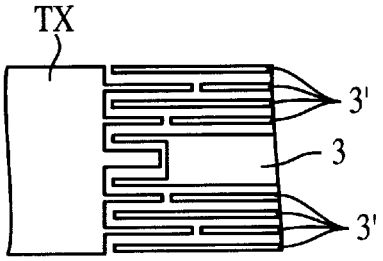
Figure 29C:
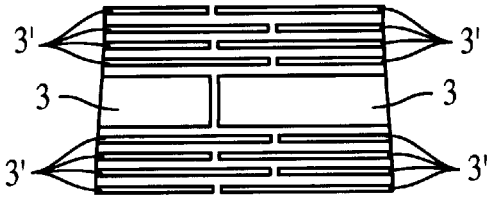
Figure 29D:
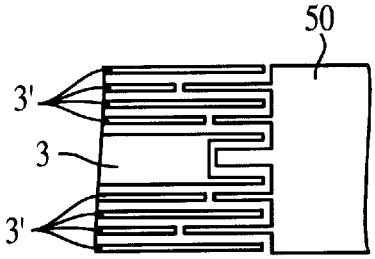

FIG. 29A is a top view illustrating the whole structure. FIGS. 29B, 29C, 29D are enlarged views of portions denoted by B, C, and D in FIG. 29A. In FIG. 29A, TX denotes a transmission signal input terminal, RX denotes a reception signal output terminal, and ANT denotes an antenna terminal. Reference numerals 51, 52, 53, and 54 denotes hairpin type resonators formed by bending microstrip line electrodes into a hairpin shape as shown in FIG. 19. Reference numeral 50 denotes a branch line.

At the boundary between the terminal TX and the microstrip line electrode of the resonator 51, as shown in FIG. 29B, the end of the central microstrip line electrode 3 and the ends of the thin line-shaped electrodes 3' at both sides of the electrode 3 are formed into a finger shape such that they are alternately long and short. The terminal TX has fingers each having a length matching the length of the corresponding thin line-shaped electrodes 3' at the boundary, and the fingers of the terminal TX and the fingers of the microstrip line electrode 3 are coupled in an interdigital fashion. At the boundary between the microstrip line electrode of the branch line 50 and the microstrip line electrode of the resonator 52, a coupling is made in a similar manner as shown in FIG. 29D. At the boundary between the resonator 51 and the resonator 52, as shown in FIG. 29C, the end of the central microstrip line electrode 3 and the ends of the thin line-shaped electrodes 3' at both sides of the electrode 3 are formed into a finger shape such that they are alternately long and short for both resonators 51 and 52, and they are coupled into an interdigital fashion. Similar couplings are formed at boundaries between the terminal RX and the resonator 54, between the resonator 52 and the branch line 50, between the branch line 50 and the resonator 53, and between the resonator 53 and the resonator 54. In this structure, strong external couplings between the resonators and the terminals and strong couplings between adjacent resonators are obtained. This allows the characteristics of the filter to be designed in a more flexible manner.

In the structure shown in FIG. 29, a transmission filter consisting of two stages of resonators 51 and 52 is formed between the terminal TX and the branch line 50, and a reception filter consisting of two stages of resonators 53 and 54 is formed between the terminal RX and the branch line 50. The line length of the branch line 50 and the connection position between the antenna terminal ANT and the branch line 50 are determined in such a manner as to obtain phases which prevent interference between the reception filter and the transmission filter.

Figure 30:
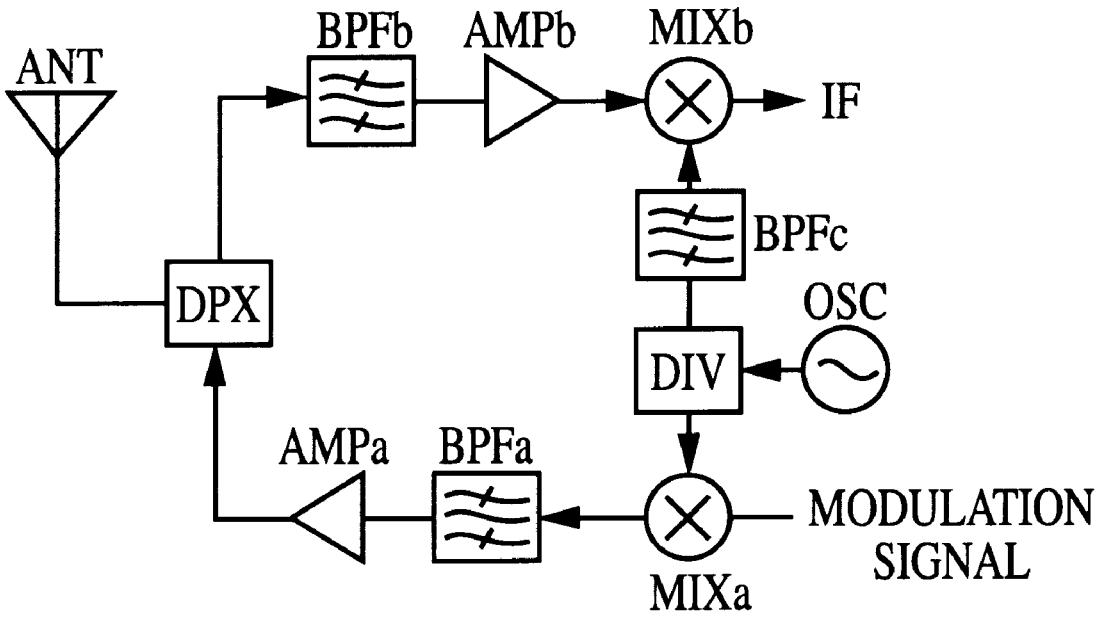
FIG. 30 is a schematic diagram illustrating the structure of a communication device.
Figures 31A, 31B, 31C, 31D, 31E:
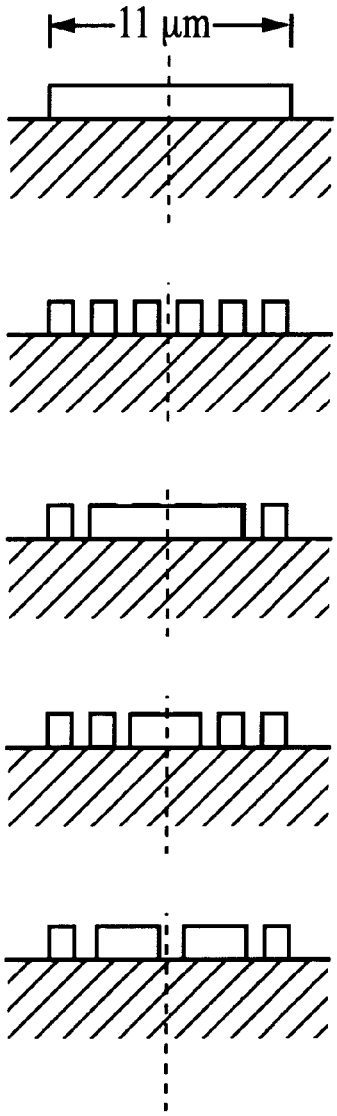
FIGS. 31A to 31E are schematic diagrams illustrating the attenuation constant simulated for high-frequency transmission lines having various structures.

Referring now to FIG. 30, a communication device using the above-described dielectric filter or duplexer is described below. As shown in FIG. 30, the communication device includes a transmission/reception antenna ANT, a duplexer DX, bandpass filters BPFa, BPFb, and BPFc, amplifiers AMPa and AMPb, mixers MIXa and MIXb, an oscillator OSC, and a frequency divider (synthesizer) DIV. The mixer MIXa modulates a frequency signal output from the frequency divider DIV in accordance to a modulation signal. The bandpass filter BPFa passes only a signal within a transmission frequency band. The amplifier AMPa performs power amplification on the output of the bandpass filter BPFa. The resultant signal is sent to the antenna via the duplexer DPX and radiated. On the other hand, the bandpass filter BPFb passes only a signal component contained in the output of the duplexer DPC within a reception frequency band. The signal output by the bandpass filter BPFb is amplified by the amplifier AMPb. The mixer MIXb mixes the frequency signal output by the bandpass filter BPFC and the reception signal and outputs an intermediate frequency signal IF.

The duplexer DPX shown in FIG. 30 may be realized using a duplexer having the structure shown in FIG. 29. The bandpass filters BPFS, BPFb, and BPFc may be realized using dielectric filters having the structure shown in FIG. 22. A voltage controlled oscillator may be employed as the oscillator OSC wherein the resonator in the oscillator may be realized using any resonator described above. Thus, it is possible to realize a communication device having a small total size and having a high power conversion efficiency.

As can be understood from the above description, the present invention has various advantages. That is, in the high-frequency transmission line according to the first aspect of the invention, the current is divided into the thin line-shaped electrode and the edge portion of the main electrode without encountering a significant reduction in the total cross-sectional area of the electrode. Thus, it is possible to further reduce the conductor loss compared with the conventional transmission line made up of thin line-shaped conductors with a fixed width over the entire with of the transmission line. In the case where a conductor loss similar to that of the conventional transmission line is allowed, it is possible to achieve a transmission line with a smaller total size and/or a smaller thickness.

In another aspect of the invention the electrode is formed into a multilayer structure consisting of thin conductive layers and thin dielectric layers so that the current flow is divided into a plurality of thin conductive layers thereby suppressing the current concentration also in the direction across the thickness of the electrode thus further reducing the total conductor loss.

In the microstrip line according to the invention, if the electrode is made of a superconductive material, the current concentration in various portions of the electrode are suppressed and thus it is possible to easily maintain superconductivity even for a rather large current.

In another aspect of the invention, when a current is going to gather into an edge portion of the electrode due to the edge effect, the current is divided into a plurality of thin conductive layers of the portion of the electrode bent in the direction substantially perpendicular to the surface of the dielectric plate. Furthermore, the effective cross-sectional area of the electrode increases in the edge portion where the edge effect occurs to a greater extent than in other portions and thus the current concentration in each thin conductive layer is also suppressed.

In the dielectric resonator according to another aspect of the present invention, the suppression in the current concentration in the edge portions results in a reduction in the total conductor loss and thus an increase in no-load Q (Qo).

According to another aspect of the invention, a small-sized filter having a low loss is achieved.

According to another aspect of the invention, a small-sized duplexer having a low loss is achieved.

According to another aspect of the invention, a small-sized filter having a high power conversion efficiency is achieved.

What is claimed is:

1. A high-frequency transmission line including a dielectric and an electrode, said high-frequency transmission line being characterized in that said electrode is formed into a multilayer structure consisting of thin conductive layers and thin dielectric layers, and an end of said electrode is bent in a direction substantially perpendicular to the surface of the dielectric.

2. A high-frequency transmission line including a dielectric and an electrode, said high-frequency transmission line being characterized in that one or more gaps are formed in an edge portion of the electrode along an edge of the electrode wherein said electrode is formed into a multilayer structure consisting of thin conductive layers and thin dielectric layers.

3. A high-frequency transmission line according to claim 2, wherein said thin conductive layers are made of a superconductive material.

4. A dielectric resonator including an electrode formed on the surface of a dielectric or in the inside of a dielectric, said dielectric resonator being characterized in that one or more gaps are formed in an edge portion of the electrode along an edge of the electrode wherein the edge portion circumscribes the electrode.

5. A filter including a dielectric resonator according to claim 4; and input/output electrodes coupled to said dielectric resonator.

6. A duplexer including a transmission filter and a reception filter each realized using a filter according to claim 5, wherein said transmission filter is disposed between a transmission signal input port and an antenna port, and said reception filter is disposed between a reception signal output port and the antenna port.

7. A dielectric resonator as in claim 4, wherein said electrode is circular and the edge portion forms a closed ring.

8. A dielectric resonator as in claim 4, wherein said electrode is rectangular and the edge portion forms a closed rectangle.

9. A rectangular strip line resonator including a first electrode formed on one surface of a dielectric, a second electrode formed on an opposite surface of said dielectric, said first electrode being a rectangular shaped resonator electrode having one or more gaps formed in an edge portion thereof along an edge of the electrode, the edge portion circumscribing the first electrode and forming a closed rectangle.

10. A circular strip line resonator including a circular shaped resonator electrode on one surface of a dielectric, a ground electrode formed on an opposite surface of said dielectric, wherein one or more gaps are formed in an edge portion of said circular shaped resonator electrode along an edge of the electrode, wherein the edge portion forms a closed ring.

11. An open circular dielectric resonator which comprises a shielded cavity and a resonator disposed in the shielded cavity, the resonator comprising first and second cylindrical dielectric poles having a cylindrical resonator electrode interposed between respective inner faces of said dielectric poles and circular ground electrodes disposed on outer end faces of the respective dielectric poles, the resonator electrode having one or more gaps formed in an edge portion of the electrode along an edge of the electrode, wherein the edge portion forms a closed ring.

12. A dielectric resonator which comprises a rectangular shaped shielded cavity, a rectangular shaped dielectric plate coextensive in size with said cavity disposed in said cavity, ground electrodes on opposite sides of said dielectric plate, each of said ground electrodes having a circular opening formed at a center area thereof, respective circular resonators formed in the circular openings on each side of the dielectric plate, each of the resonators having a plurality of thin line shaped electrodes formed adjacent to the outer edge of said circular resonator and extending around said circular edge to form a closed ring.

* * * * *